US012409530B2

(12) United States Patent
Wang et al.

(10) Patent No.: US 12,409,530 B2
(45) Date of Patent: Sep. 9, 2025

(54) BONDED ABRASIVE WITH LOW WETTING BOND MATERIAL

(71) Applicants: SAINT-GOBAIN ABRASIVES, INC., Worcester, MA (US); SAINT-GOBAIN ABRASIFS, Conflans-Sainte-Honorine (FR)

(72) Inventors: Qing Wang, Shanghai (CN); Guangyong Lin, Shrewsbury, MA (US); Nilanjan Sarangi, Shrewsbury, MA (US); Zhenyu Luo, Shanghai (CN); Lu Lu, Shanghai (CN)

(73) Assignees: SAINT-GOBAIN ABRASIVES, INC., Worcester, MA (US); SAINT-GOBAIN SURFACE SOLUTIONS FRANCE, Conflans-Sainte-Honorine (FR)

( * ) Notice: Subject to any disclaimer, the term of this patent is extended or adjusted under 35 U.S.C. 154(b) by 0 days.

(21) Appl. No.: 18/501,651

(22) Filed: Nov. 3, 2023

(65) Prior Publication Data

US 2024/0149398 A1 May 9, 2024

(30) Foreign Application Priority Data

Nov. 4, 2022 (CN) ..... 202211376873.3

(51) Int. Cl.
*B24D 18/00* (2006.01)
*B24D 5/02* (2006.01)

(52) U.S. Cl.
CPC ..... *B24D 5/02* (2013.01); *B24D 18/0072* (2013.01)

(58) Field of Classification Search
CPC ..... B24D 5/02; B24D 18/0072
USPC ..... 51/293, 307, 308
See application file for complete search history.

(56) References Cited

U.S. PATENT DOCUMENTS

| | | | |
|---|---|---|---|
| 6,679,758 | B2 | 1/2004 | Bright et al. |
| 6,805,620 | B2 | 10/2004 | Iwai et al. |
| 7,722,691 | B2 | 5/2010 | Orlhac et al. |
| 8,123,828 | B2 | 2/2012 | Culler et al. |
| 8,142,531 | B2 | 3/2012 | Adefris et al. |
| 8,475,553 | B2 | 7/2013 | Orlhac et al. |

(Continued)

FOREIGN PATENT DOCUMENTS

| | | | | |
|---|---|---|---|---|
| CN | 103079766 A | * | 5/2013 | ..... B24D 18/00 |
| EP | 0692342 A2 | | 1/1996 | |

(Continued)

OTHER PUBLICATIONS

Bergs Thomas "Cutting force model for gear honing", 2018, p. 53-56, vol. 67, Issue 1, CIRP Annals.

(Continued)

*Primary Examiner* — James E McDonough
(74) *Attorney, Agent, or Firm* — Abel Schillinger, LLP; Arpan Ghosh

(57) ABSTRACT

The subject application relates to bonded abrasive with low wetting bond material. An abrasive article including a bonded abrasive body having a particular MOR/EMOD ratio associated with a particular bond vol %. The body also can include a) an average Bond Post Area (BPA) of not greater than microns$^2$; b) an average Bond Post Count (BPC) of at least 140 per 1536 mm$^2$; c) an average bond wetting radius of at least 30/microns; or d) a combination of a) and b).

10 Claims, 9 Drawing Sheets

(56) References Cited

U.S. PATENT DOCUMENTS

| | | | |
|---|---|---|---|
| 9,168,637 | B2 | 10/2015 | Mizuno et al. |
| 9,656,338 | B2 | 5/2017 | Nuriya et al. |
| 9,956,664 | B2 | 5/2018 | Lehuu et al. |
| 10,800,006 | B2 | 10/2020 | Didavide et al. |
| 2002/0088183 | A1 | 7/2002 | Manwiller et al. |
| 2004/0176019 | A1 | 9/2004 | Iwai et al. |
| 2011/0045292 | A1 | 2/2011 | Tian et al. |
| 2014/0182214 | A1 | 7/2014 | Sivasubramanian et al. |
| 2014/0287658 | A1 | 9/2014 | Flaschberger et al. |
| 2016/0023328 | A1 | 1/2016 | Flaschberger et al. |
| 2017/0008153 | A1 | 1/2017 | Sivasubramanian et al. |
| 2019/0375073 | A1 | 12/2019 | Martin et al. |
| 2020/0001429 | A1 | 1/2020 | Rapaka et al. |
| 2020/0238477 | A1 | 7/2020 | Amino et al. |
| 2022/0080553 | A1 | 3/2022 | Beiermann et al. |
| 2022/0134512 | A1 | 5/2022 | Fritz et al. |

FOREIGN PATENT DOCUMENTS

| | | | | |
|---|---|---|---|---|
| EP | 1355757 | B1 | 4/2005 | |
| EP | 2969394 | B1 | 1/2016 | |
| EP | 2753456 | B1 | 2/2020 | |
| JP | 2002326123 | A | 11/2002 | |
| JP | 2010017789 | A | 1/2010 | |
| WO | WO-2017007999 | A1 * | 1/2017 | ..... B24D 18/00 |
| WO | 2018049204 | A1 | 3/2018 | |
| WO | WO-2021119319 | A1 * | 6/2021 | ..... B22F 10/14 |
| WO | WO-2023279024 | A1 * | 1/2023 | ..... B24D 3/04 |

OTHER PUBLICATIONS

International Search Report and Written Opinion for PCT/US2023/078659, dated Feb. 23, 2024, 10 pages.

Glaser Thomas et al., Hard Machining of Spur Gears with the InvoMilling TM Method, Journal of Manufacturing and Materials Processing, Jul. 11, 2018, p. 1-18, vol. 2, Issue 3, article 44.

International Search Report for PCT/US2023/078659, dated Feb. 23, 2024, 3 pages.

International Search Report for PCT/US2023/078716, dated Mar. 5, 2024, 2 pages.

Guerrini Giacomo et al. "Dry Grinding of Gears for Sustainable Automotive Transmission Production." Journal of Cleaner Production. Mar. 1, 2018, p. 76-88, vol. 176.

* cited by examiner

BONDED ABRASIVE WITH LOW WETTING BOND MATERIAL

CROSS-REFERENCE TO RELATED APPLICATION(S)

This application claims priority to Chinese Patent Application No. 202211376873.3, filed Nov. 4, 2022, by Qing WANG et al., entitled "BONDED ABRASIVE WITH LOW WETTING BOND MATERIAL," which is assigned to the current assignees hereof and incorporated herein by reference in its entirety for all purposes.

BACKGROUND OF THE INVENTION

Field of the Disclosure

The present invention relates in general to abrasive articles, and in particular, to bonded abrasive articles having a low wetting bond material and a unique microstructure.

Description of the Related Art

Abrasive articles used in machining applications typically include bonded abrasive articles and coated abrasive articles. A bonded abrasive article generally has a bond matrix containing abrasive particles. Bonded abrasive articles can be mounted onto a suitable machining apparatus and used in various applications, such as shaping, grinding, polishing, and cutting. The industry continues to demand improved abrasive tools.

SUMMARY OF THE INVENTION

In one embodiment, the subject application provides an abrasive article, comprising:

a body comprising:

a bond material comprising an inorganic material;

abrasive particles contained in a bond material;

a MOR/EMOD ratio of at least 0.92; a bond vol % of less than 18% and wherein the body further comprises at least one of:

a) an average Bond Post Area (BPA) of not greater than 2400 microns$^2$;

b) an average Bond Post Count (BPC) of at least 140 per 1.536 mm$^2$;

c) an average bond wetting radius of at least 30 microns; and d) a combination of a) and b).

In another embodiment, the subject application provides an abrasive article, comprising:

a body comprising:

a bond material comprising an inorganic material;

abrasive particles contained in a bond material;

a MOR/EMOD ratio of at least 1.05; a bond vol % of at least 18% and not greater than 30% and wherein the body further comprises at least one of:

a) an average Bond Post Area (BPA) of not greater than 2400 microns$^2$;

b) an average Bond Post Count (BPC) of at least 140 per 1.536 mm$^2$;

c) an average bond wetting radius of at least 30 microns; and d) a combination of a) and b).

In yet another embodiment, the subject application provides a method of making an abrasive article, comprising, providing a mixture of abrasive particles and a bond material precursor;

pressing the mixture into a green body;

firing the green body into a fully formed abrasive article.

In still another embodiment, the subject application provides a method of using an abrasive article to abrade a workpiece, the method comprising, cutting, beveling, sharpening, gear power honing, worm gear grinding, CMR, stock removal, grinding, weld blending, or precision finishing.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is generally directed to bonded abrasive articles suitable for use in material removal operations. The bonded abrasive articles can be used in various applications, including, for example, surface grinding, precision grinding operations (e.g., gear grinding operations), and the like.

Reference herein to bonded abrasive articles includes reference to a three-dimensional volume of an abrasive material having abrasive particles contained within a volume of a bond material. Bonded abrasive articles can be distinct from coated abrasive articles that may utilize a single layer of abrasive particles contained in a layer of bond or adhesive material. Moreover, the bonded abrasive articles of embodiments herein may include some porosity within the three-dimensional volume of a bond material.

Figure 1:
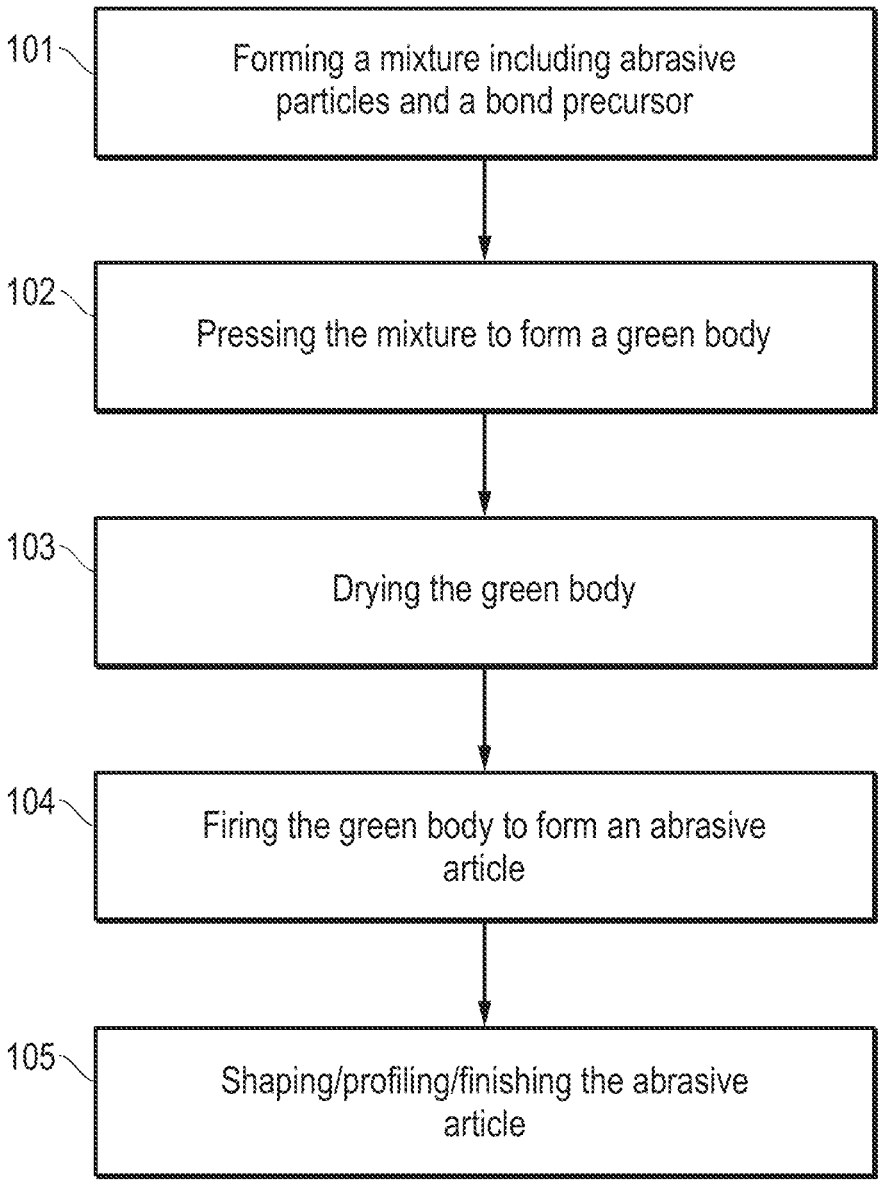
FIG. 1 includes a flowchart for forming an abrasive article in accordance with an embodiment.

FIG. 1 includes a flowchart for forming an abrasive article in accordance with an embodiment. As illustrated, the process for forming the abrasive article can begin at step 101 by forming a mixture that includes a bond precursor material. The mixture can be a slurry, including a plurality of components homogeneously mixed in therein.

A bond precursor material may be a material that becomes the bond material of the final-formed abrasive article. In accordance with an embodiment, the bond precursor material can include a powder material configured to form the bond material of the final-formed abrasive article. In one embodiment, the bond precursor material can include an inorganic material, such as, but not limited to, metals, metal alloys, ceramics, vitreous materials or frit materials, or any combination thereof. The bond precursor material may include inorganic material in an amorphous phase, polycrystalline phase, monocrystalline phase, or any combination thereof.

The bond material precursor may have a particular composition that may facilitate improved performance or manufacturing of the abrasive article.

In an embodiment, the bond material precursor can include a content of $Al_2O_3$ of at least 18 wt % or at least 20 wt % or at least 22 wt %. In an embodiment, the bond material precursor can include a content of $Al_2O_3$ of not greater than 36 wt % for a total content of the bond material or not greater than 33 wt % or not greater than 30 wt % or not greater than 27 wt %. It will be appreciated that the $Al_2O_3$ content may be between any of the minimum and maximum values noted above.

In an embodiment, the bond material precursor can include a content of $SiO_2$ of at least 38 wt % or at least 40 wt % or at least 42 wt % or at least 45 wt %. In an embodiment, the bond material precursor can include a content of $SiO_2$ of not greater than 55 wt % for a total content of the bond material. It will be appreciated that the $SiO_2$ content may be between any of the minimum and maximum values noted above.

In an embodiment, the bond material precursor can include a content of $B_2O_3$ of at least 10 wt %. In an embodiment, the bond material precursor can include a content of $B_2O_3$ not greater than 18 wt % or not greater than 15 wt % for a total content of the bond material. It will be appreciated that the $B_2O_3$ content may be between any of the minimum and maximum values noted above.

In an embodiment, the bond material precursor can include a content of BaO of not greater than 0.6 wt % or not greater than 0.4 wt % or not greater than 0.2 wt % or not greater than 0.1 wt % or not greater than 0.05 wt % or not greater than 0.03 wt % for a total content of the bond material.

In an embodiment, the bond material precursor can include a content of CaO of at least 0.3 wt %. In an embodiment, the bond material precursor can include a content of CaO of not greater than 2 wt % or not greater than 1.5 wt % or not greater than 1 wt % or not greater than 0.5 wt % for a total content of the bond material. It will be appreciated that the CaO content may be between any of the minimum and maximum values noted above.

In an embodiment, the bond material precursor can include a content of CoO of not greater than 0.7 wt % for a total content of the bond material.

In an embodiment, the bond material precursor can include a content of $Cr_2O_3$ of not greater than 0.01 wt % for a total content of the bond material.

In an embodiment, the bond material precursor can include a content of $Fe_2O_3$ of not greater than 0.8 wt % or not greater than 0.7 wt % for a total content of the bond material.

In an embodiment, the bond material precursor can include a content of CuO of not greater than 0.01 wt % for a total content of the bond material.

In an embodiment, the bond material precursor can include a content of $HfO_2$ of not greater than 0.02 wt % for a total content of the bond material.

In an embodiment, the bond material precursor can include a content of $K_2O$ of at least 0.5 wt %. In an embodiment, the bond material precursor can include a content of $K_2O$ of not greater than 2 wt % or not greater than 1 wt % for a total content of the bond material. It will be appreciated that the $K_2O$ content may be between any of the minimum and maximum values noted above.

In an embodiment, the bond material precursor can include a content of $La_2O_2$ of at least 1.3 wt %. In an embodiment, the bond material precursor can include a content of $La_2O_2$ of not greater than 2.0 wt % or not greater than 1.5 wt % for a total content of the bond material. It will be appreciated that the $La_2O_2$ content may be between any of the minimum and maximum values noted above.

In an embodiment, the bond material precursor can include a content of $Li_2O$ of at least 0.2 wt % or at least 0.5 wt % or at least 0.7 wt % or at least 0.9 wt %. In an embodiment, the bond material precursor can include a content of $Li_2O$ of not greater than 3 wt % or not greater than 2.5 wt % or not greater than 2.0 wt % or not greater than 1.5 wt % or not greater than 1.1 wt % for a total content of the bond material. It will be appreciated that the $Li_2O$ content may be between any of the minimum and maximum values noted above.

In an embodiment, the bond material precursor can include a content of MgO of at least 0.5 wt % or at least 0.7 wt %. In an embodiment, the bond material precursor can include a content of MgO of not greater than 1.5 wt % or 1.0 wt % for a total content of the bond material. It will be appreciated that the MgO content may be between any of the minimum and maximum values noted above.

In an embodiment, the bond material precursor can include a content of $MnO_2$ of not greater than 0.05 wt %. In an embodiment, the bond material precursor can include a content of $MnO_2$ of not greater than 0.02 wt % for a total content of the bond material. It will be appreciated that the $MnO_2$ content may be between any of the minimum and maximum values noted above.

In an embodiment, the bond material precursor can include a content of $Na_2O$ of at least 4 wt %. In an embodiment, the bond material precursor can include a content of $Na_2O$ of not greater than 12 wt % or not greater than 9 wt % or not greater than 6 wt % for a total content of the bond material. It will be appreciated that the $Na_2O$ content may be between any of the minimum and maximum values noted above.

In an embodiment, the bond material precursor can include a content of NiO of not greater than 0.01 wt % for a total content of the bond material.

In an embodiment, the bond material precursor can include a content of SrO of not greater than 0.02 wt % for a total content of the bond material.

In an embodiment, the bond material precursor can include a content of $TiO_2$ of at least 0.2 wt % and not greater than 0.8 wt % for a total content of the bond material.

In an embodiment, the bond material precursor can include a content of $V_2O_5$ of not greater than 0.02 wt % for a total content of the bond material.

In an embodiment, the bond material precursor can include a content of $Y_2O_3$ of at least 0.4 wt % and not greater than 1.0 wt % for a total content of the bond material.

In an embodiment, the bond material precursor can include a content of ZnO of not greater than 0.2 wt % for a total content of the bond material.

In an embodiment, the bond material precursor can include a content of $ZrO_2$ of not greater than 0.01 wt % for a total content of the bond material.

In accordance with one embodiment, the bond precursor material may be added in a particular content. For example, the mixture may include at least 1 vol % of the bond precursor material for a total volume of the mixture, such as at least 2 vol % or at least 3 vol % or at least 4 vol % or at least 5 vol % or at least 6 vol % or at least 7 vol % or at least 8 vol % or at least 9 vol % or at least 10 vol % or at least 12 vol % or at least 14 vol % or at least 16 vol % or at least 18 vol % or at least 20 vol % or at least 22 vol % or at least 24 vol % or at least 26 vol % or at least 28 vol % or at least 30 vol % or at least 32 vol % or at least 34 vol % or at least 36 vol % or at least 38 vol % or at least 40 vol %. In another embodiment, the mixture may include at least 1 wt % of the bond precursor material for a total weight of the mixture, such as at least 2 wt % or at least 3 wt % or at least 4 wt % or at least 5 wt % or at least 6 wt % or at least 7 wt % or at least 8 wt % or at least 9 wt % or at least 10 wt % or at least 12 wt % or at least 14 wt % or at least 16 wt % or at least 18 wt % or at least 20 wt % or at least 22 wt % or at least 24 wt % or at least 26 wt % or at least 28 wt % or at least 30 wt % or at least 32 wt % or at least 34 wt % or at least 36 wt % or at least 38 wt % or at least 40 wt %. Still, in one non-limiting embodiment, the mixture may include not greater than 40 vol % of the bond precursor material for a total volume of the mixture, such as not greater than 38 vol % or not greater than 35 vol % or not greater than 32 vol % or not greater than 30 vol % or not greater than 28 vol % or not greater than 25 vol % or not greater than 22 vol % or not greater than 20 vol % or not greater than 18 vol % or not greater than 15 vol %. In another non-limiting embodiment, the mixture may include not greater than 40 wt % of the bond precursor material for a total weight of the mixture, such as not greater than 38 wt % or not greater than 35 wt % or not greater than 32 wt % or not greater than 30 wt % or not greater than 28 wt % or not greater than 25 wt % or not greater than 22 wt % or not greater than 20 wt % or not greater than 18 wt % or not greater than 15 wt %. The mixture may include a content of the bond precursor material in an amount within a range, including any of the minimum and maximum percentages noted above.

The mixture may further include abrasive particles configured to form the abrasive component of the final-formed abrasive article. The abrasive particles may be added to the mixture at various times, including, for example, after the addition of the bond precursor material to the mixture. Still, it will be appreciated, in other embodiments, the abrasive particles may be added in combination with one or more of the other components in the mixture, including, for example, but not limited to the gelling agent, the bond precursor material, or one or more additives. The abrasive particles may include a material such as from the group consisting of oxides, borides, nitrides, carbides, oxynitrides, oxycarbides, amorphous, monocrystalline, polycrystalline, superabrasive, diamond, or any combination thereof. In an embodiment, at least one material is from the group of alumina, silica, zirconia, or any combination thereof. In one particular embodiment, the abrasive particles can include alumina, and may consist essentially of alumina. In an embodiment, the abrasive particles comprise at least one of fused alumina, unseeded alumina, seeded sol-gel alumina, alumina with one or more magnetoplumbite-containing phases. In an embodiment, the abrasive particles can include doped alumina. In an embodiment, the abrasive particles can include La or MgO, or a combination thereof.

In an embodiment, the abrasive particles can include at least one of unshaped particles (e.g., crushed), shaped particles, agglomerated particles, unagglomerated particles.

The mixture may include a certain content of abrasive particles to facilitate improved manufacturing and/or improved performance of the abrasive article. For example, in one embodiment, the mixture may include at least 20 vol % of the abrasive particles for a total volume of the mixture, such as at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol % or at least 80 vol %. In one embodiment, the mixture may include at least 20 wt % of the abrasive particles for a total weight of the mixture, such as at least 25 wt % or at least 30 wt % or at least 35 wt % or at least 40 wt % or at least 45 wt % or at least 50 wt % or at least 55 wt % or at least 60 wt % or at least 65 wt % or at least 70 wt % or at least 75 wt % or at least 80 wt %. In another non-limiting embodiment, the mixture may include not greater than 80 vol % of the abrasive particles for a total volume of the mixture, such as not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol %, such as not greater than 25 vol %. In another non-limiting embodiment, the mixture may include not greater than 80 wt % of the abrasive particles for a total weight of the mixture, such as not greater than 75 wt % or not greater than 70 wt % or not greater than 65 wt % or not greater than 60 wt % or not greater than 55 wt % or not greater than 50 wt % or not greater than 45 wt % or not greater than 40 wt % or not greater than 35 wt % or not greater than 30 wt %, such as not greater than 25 wt %. The mixture may include a content of the abrasive particles in an amount within a range, including any of the minimum and maximum percentages noted above.

In an embodiment, the abrasive particles can have a polycrystalline phase having crystalline domains, the crystalline domains having an average domain size of not greater than 8 microns or not greater than 7 microns or not greater than 6 microns or not greater than 5 microns or not greater than 4 microns or not greater than 3 microns or not greater than 2 microns or not greater than 1 micron or not greater than 0.5 microns or not greater than 0.3 microns according to the uncorrected intercept method. In an embodiment, the abrasive particles can have a polycrystalline phase having crystalline domains having an average domain size of at least 0.1 microns or at least 0.2 microns or at least 0.3 microns or at least 0.4 microns or at least 0.5 microns or at least 0.75 microns or at least 1 microns or at least 1.5 microns or at least 2 microns or at least 2.5 microns or at least 3 microns or at least 3.5 microns or at least 4 microns or at least 4.5 microns or at least 5 microns. It will be appreciated that the average crystalline domain size may be between any of the minimum and maximum values noted above.

The mixture can include a particular ratio of abrasive particles to bond content (APv/ABv) that may facilitate improved performance and/or manufacturing of the abrasive article. In an embodiment, APv/ABv can be at least 1 or at least 1.1 or at least 1.2 or at least 1.3 or at least 1.4 or at least 1.5 or at least 1.6 or at least 1.7 or at least 1.8 or at least 1.9 or at least 2.0 or at least 2.1 or at least 2.2 or at least 2.3 or at least 2.4 or at least 2.5 or at least 2.6. In an embodiment, APv/ABv can be not greater than 10 or not greater than 9 or not greater than 8 or not greater than 7 or not greater than 6 or not greater than 5 or not greater than 4.5 or not greater than 4.0 or not greater than 3.9 or not greater than 3.8 or not greater than 3.7 or not greater than 3.6 or not greater than 3.5 or not greater than 3.4 or not greater than 3.3 or not greater than 3.2 or not greater than 3.1 or not greater than 3.0. It will be appreciated that APv/ABv can be between any of the minimum and maximum values noted above.

Figure 3:
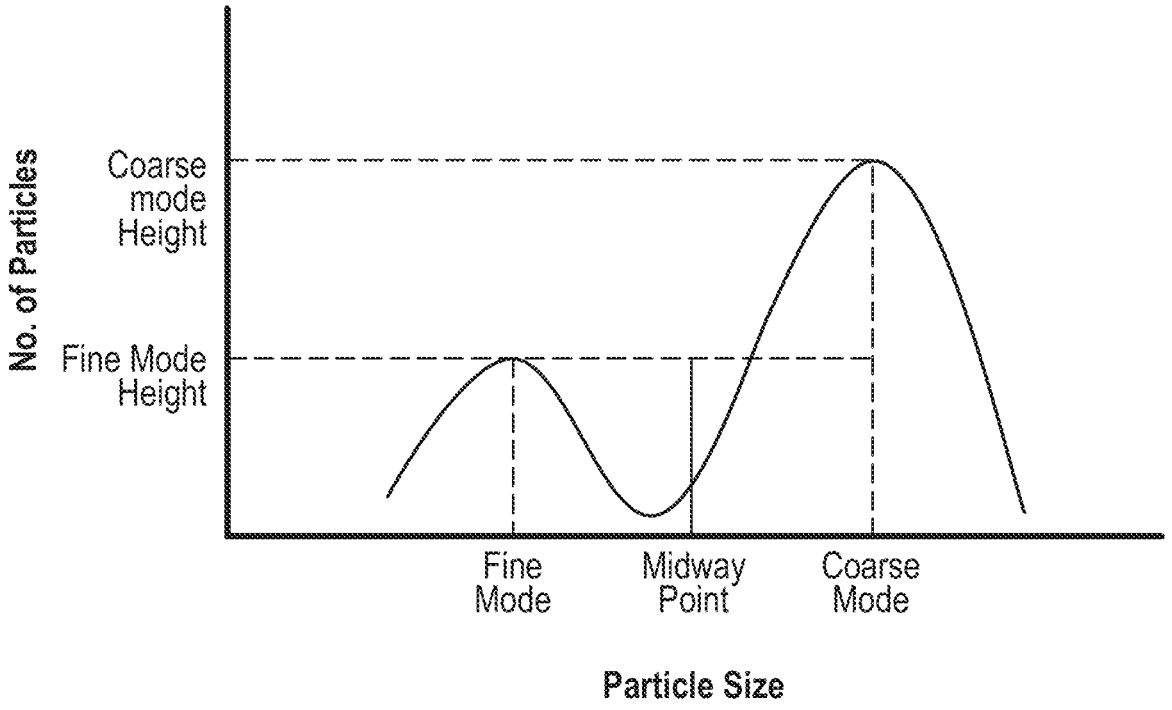
FIG. 3 includes an example of a multimodal particle size distribution.

In an embodiment, the abrasive particles can have a multimodal particle size distribution. An exemplary particle size distribution can be found in FIG. 3. The multimodal particle size distribution can have a fine mode and a coarse mode, and a midway point equal to the mean of the particle sizes corresponding to the fine mode and the coarse mode.

In an embodiment, the coarse mode can correspond to a particular particle size that may facilitate improved performance and/or manufacturing of the abrasive article. In an embodiment, the coarse mode can be at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns. In an embodiment the coarse mode can be not greater than 1000 microns or not greater than 800 microns or not greater than 600 microns or not greater than 500 microns or not greater than 400 microns or not greater than 300 microns or not greater than 200 microns or not greater than 190 microns or not greater than 185 microns or not greater than 180 microns or not greater than 175 microns or not greater than 170 microns or not greater than 165 microns or not greater than 160 microns or not greater than 155 microns or not greater than 150 microns or not greater than 145 microns or not greater than 140 microns or not greater than 135 microns or not greater than 130 microns or not greater than 125 microns or not greater than 120 microns or not greater than 115 microns or not greater than 110 microns or not greater than 105 microns or not greater than 100 microns or not greater than 95 microns or not greater than 90 microns or not greater than 85 microns or not greater than 80 microns or not greater than 75 microns or not greater than 70 microns. It will be appreciated that the coarse mode can be between any of the minimum and maximum values noted above.

In an embodiment, the fine mode can correspond to a particular particle size that may facilitate improved performance and/or manufacturing of the abrasive article. In an embodiment, the fine mode can be at least 1 micron or at least 2 microns or at least 3 microns or at least 4 microns or at least 5 microns or at least 6 microns or at least 7 microns or at least 8 microns or at least 9 microns or at least 10 microns or at least 11 microns or at least 12 microns or at least 13 microns or at least 14 microns or at least 15 microns or at least 16 microns or at least 17 microns or at least 18 microns or at least 19 microns or at least 20 microns or at least 21 microns or at least 22 microns or at least 23 microns or at least 24 microns or at least 25 microns or at least 26 microns or at least 27 microns or at least 28 microns. In an embodiment, the fine mode can be not greater than 80 microns or not greater than 78 microns or not greater than 76 microns or not greater than 74 microns or not greater than 72 microns or not greater than 70 microns or not greater than 68 microns or not greater than 66 microns or not greater than 64 microns or not greater than 62 not greater than 60 microns or not greater than 58 microns or not greater than 56 microns or not greater than 54 microns or not greater than 52 microns or not greater than 50 microns or not greater than 48 microns or not greater than 46 microns or not greater than 44 microns or not greater than 42 microns or not greater than 40 microns or not greater than 38 microns or not greater than 36 microns or not greater than 34 microns or not greater than 32 microns or not greater than 30 microns. It will be appreciated that the fine mode can be between any of the minimum and maximum values noted above.

In an embodiment, the difference between the fine and coarse modes can correspond to a particular particle size that may facilitate improved performance and/or manufacturing of the abrasive article. In an embodiment, the difference between the fine and coarse modes can be at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns. In an embodiment the difference between the fine and coarse modes can be not greater than 1000 microns or not greater than 800 microns or not greater than 600 microns or not greater than 500 microns or not greater than 400 microns or not greater than 300 microns or not greater than 200 microns or not greater than 190 microns or not greater than 185 microns or not greater than 180 microns or not greater than 175 microns or not greater than 170 microns or not greater than 165 microns or not greater than 160 microns or not greater than 155 microns or not greater than 150 microns or not greater than 145 microns or not greater than 140 microns or not greater than 135 microns or not greater than 130 microns or not greater than 125 microns or not greater than 120 microns or not greater than 115 microns or not greater than 110 microns or not greater than 105 microns or not greater than 100 microns or not greater than 95 microns or not greater than 90 microns or not greater than 85 microns or not greater than 80 microns or not greater than 75 microns or not greater than 70 microns. It will be appreciated that the difference between the fine and coarse modes can be between any of the minimum and maximum values noted above.

In an embodiment, the multimodal particle size distribution can include vol % ratio, [Vc/Vf] wherein Vc represents the vol % of the coarse abrasive particles having a particle size above the mean of the fine mode and the coarse mode and Vf represents the vol % of abrasive particles having a particle size below the mean of the fine mode and the coarse mode. In an embodiment, [Vc/Vf] can be at least 0.5 or at least 0.6 or at least 0.7 or at least 0.8 or at least 0.9 or at least 1 or at least 1.1 or at least 1.2 or at least 1.3 or at least 1.4 or at least 1.5 or at least 2 or at least 3 or at least 4 or at least 5 or at least 6 or at least 7 or at least 8. In an embodiment [Vc/Vf] can be not greater than 100 or not greater than 75 or not greater than 50 or not greater than 40 or not greater than 30 or not greater than 20 or not greater than 15 or not greater than 12 or not greater than 10 or not greater than 9 or not greater than 8 or not greater than 7 or not greater than 6 or not greater than 5. It will be appreciated that the [Vc/Vf] may be between any of the minimum and maximum values noted above.

After mixing, the mixture may be molded and pressed to form a green abrasive body. In an embodiment, the mixture can be pressed with a particular amount of force that may facilitate improved performance and/or manufacturing of the abrasive article. In an embodiment, the pressing force can be at least 300 Ton or at least 310 Ton or at least 320 Ton or at least 330 Ton or at least 340 Ton or at least 350 Ton or at least 360 Ton or at least 370 Ton or at least 380 Ton or at least 390 Ton or at least 400 Ton or at least 410 Ton or at least 420 Ton or at least 430 Ton or at least 440 Ton or at least 450 Ton or at least 460 Ton or at least 470 Ton or at least 480 Ton or at least 490 Ton or at least 500 Ton. In an embodiment, the pressing force can be of not greater than 1000 Ton or not greater than 950 Ton or not greater than 900 Ton or not greater than 850 Ton or not greater than 800 Ton or not greater than 750 Ton or not greater than 700 Ton or not greater than 650 Ton or not greater than 600 Ton or not greater than 550 Ton or not greater than 500 Ton or not greater than 450 Ton or not greater than 400 Ton or not greater than 350 Ton. It will be appreciated that the pressing force may be between any of the minimum and maximum values noted above.

In an embodiment, the mixture can be pressed with a particular pressure that may facilitate improved performance and/or manufacturing of the abrasive article. In an embodiment, the pressing pressure can be at least 90 MPa or at least 95 MPa or at least 100 MPa or at least 105 MPa or at least 110 MPa. In an embodiment, the pressing pressure can be no greater than 200 MPa or no greater than 195 MPa or no greater than 190 MPa or no greater than 185 MPa or no greater than 180 MPa.

After pressing, the green body may be dried under controlled humidity. Drying may be done at a particular humidity that may facilitate improved performance and/or manufacturing of the abrasive article. In an embodiment, drying can be done with at least 30% humidity or at least 32% humidity or at least 34% humidity or at least 36% humidity or at least 38% humidity or at least 40% humidity or at least 42% humidity or at least 44% humidity or at least 46% humidity or at least 48% humidity or at least 50% humidity or at least 52% humidity or at least 54% humidity or at least 56% humidity or at least 58% humidity or at least 60% humidity. In an embodiment, drying can be done with no greater than 60% humidity or no greater than 58% humidity or no greater than 56% humidity or no greater than 54% humidity or no greater than 52% humidity or no greater than 50% humidity or no greater than 48% humidity or no greater than 46% humidity or no greater than 44% humidity or no greater than 42% humidity or no greater than 40% humidity or no greater than 38% humidity or no greater than 36% humidity or no greater than 34% humidity or no greater than 32% humidity or no greater than 30% humidity. It will be appreciated that the drying humidity can be between any of the minimum and maximum values noted above.

Drying may be done at a particular temperature that may facilitate improved performance and/or manufacturing of the abrasive article. In an embodiment, the drying temperature can be at least 40° C. or at least 41° C. or at least 42° C. or at least 43° C. or at least 44° C. or at least 45° C. or at least 46° C. or at least 47° C. or at least 48° C. or at least 49° C. or at least 50° C. or at least 51° C. or at least 52° C. or at least 53° C. or at least 54° C. or at least 55° C. or at least 56° C. or at least 57° C. or at least 58° C. or at least 59° C. or at least 60° C. In an embodiment, the drying temperature can be no greater than 80° C. no greater than 79° C. or no greater than 78° C. or no greater than 77° C. or no greater than 76° C. or no greater than 75° C. or no greater than 74° C. or no greater than 73° C. or no greater than 72° C. or no greater than 71° C. or no greater than 70° C. or no greater than 69° C. or no greater than 68° C. or no greater than 67° C. or no greater than 66° C. or no greater than 65° C. or no greater than 64° C. or no greater than 63° C. or no greater than 62° C. or no greater than 61° C. or no greater than 60° C. or no greater than 59° C. or no greater than 58° C. or no greater than 57° C. or no greater than 56° C. or no greater than 55° C. or no greater than 54° C. or no greater than 53° C. or no greater than 52° C. or no greater than 51° C. or no greater than 50° C. It will be appreciated that the drying temperature can be between any of the minimum and maximum values noted above.

Once dry, the green body is fired into a fully formed abrasive article. In an embodiment, the green body can be fired at a particular temperature that may facilitate improved performance and/or manufacturing of the abrasive article. In an embodiment, the firing temperature can be at least 800° C. or at least 810° C. or at least 820° C. or at least 830° C. or at least 840° C. or at least 850° C. or at least 860° C. or at least 870° C. or at least 880° C. or at least 890° C. or at least 900° C. or at least 905° C. or at least 910° C. or at least 915° C. or at least 920° C. or at least 925° C. or at least 930° C. or at least 935° C. or at least 940° C. or at least 945° C. or at least 950° C. or at least 955° C. or at least 960° C. or at least 965° C. or at least 970° C. or at least 975° C. or at least 980° C. or at least 995° C. or at least 1000° C. In an embodiment, the firing temperature can be no greater than 1300° C. or no greater than 1290° C. or no greater than 1280° C. or no greater than 1270° C. or no greater than 1260° C. or no greater than 1250° C. or no greater than 1240° C. or no greater than 1230° C. or no greater than 1220° C. or no greater than 1210° C. or no greater than 1200° C. or no greater than 1190° C. or no greater than 1180° C. or no greater than 1170° C. or no greater than 1160° C. or no greater than 1150° C. or no greater than 1140° C. or no greater than 1130° C. or no greater than 1120° C. or no greater than 1110° C. or no greater than 1100° C. or no greater than 1090° C. or no greater than 1080° C. or no greater than 1070° C. or no greater than 1060° C. or no greater than 1050° C. or no greater than 1040° C. or no greater than 1030° C. or no greater than 1020° C. or no greater than 1010° C. no greater than 1000° C. or no greater than 995° C. or no greater than 990° C. or no greater than 985° C. or no greater than 980° C. or no greater than 975° C. or no greater than 970° C. or no greater than 965° C. or no greater than 960° C. or no greater than 955° C. or no greater than 950° C. or no greater than 945° C. or no greater than 940° C. or no greater than 935° C. or no greater than 930° C. or no greater than 925° C. or no greater than 920° C. or no greater than 915° C. or no greater than 910° C. or no greater than 905° C. or no greater than 900° C. or no greater than 890° C. or no greater than 880° C. or no greater than 870° C. or no greater than 860° C. or no greater than 850° C. or no greater than 840° C. or no greater than 830° C. or no greater than 820° C. or no greater than 810° C. or no greater than 800° C. It will be appreciated that the firing temperature may be between any of the minimum and maximum values noted above.

The final-formed abrasive article may be a bonded abrasive body defining an interconnected network of bond material that contains abrasive particles in the three-dimensional volume (i.e., matrix) of the bond material. Furthermore, the bonded abrasive body may have an amount of porosity distributed throughout the body and defining a phase that is distinct from the phases of the bond material and abrasive particles.

In accordance with an embodiment, the bond material can include a material configured to form the bond material of the final-formed abrasive article. In one embodiment, the bond material can include an inorganic material, such as, but not limited to, metals, metal alloys, ceramics, vitreous materials or frit materials, or any combination thereof. The bond material may include inorganic material in an amorphous phase, polycrystalline phase, monocrystalline phase, or any combination thereof.

The bond material may have a particular composition that may facilitate improved performance or manufacturing of the abrasive article. In an embodiment, the bond material can include a content of $Al_2O_3$ of at least 18 wt % or at least 20 wt % or at least 22 wt %. In an embodiment, the bond material can include a content of $Al_2O_3$ of not greater than 36 wt % for a total content of the bond material or not greater than 33 wt % or not greater than 30 wt % or not greater than 27 wt %. It will be appreciated that the $Al_2O_3$ content may be between any of the minimum and maximum values noted above.

In an embodiment, the bond material can include a content of $SiO_2$ of at least 38 wt % or at least 40 wt % or at least 42 wt % or at least 45 wt %. In an embodiment, the bond material can include a content of $SiO_2$ of not greater than 55 wt % for a total content of the bond material. It will be appreciated that the $SiO_2$ content may be between any of the minimum and maximum values noted above.

In an embodiment, the bond material can include a content of $B_2O_3$ of at least 10 wt %. In an embodiment, the bond material can include a content of $B_2O_3$ not greater than 18 wt % or not greater than 15 wt % for a total content of the bond material. It will be appreciated that the $B_2O_3$ content may be between any of the minimum and maximum values noted above.

In an embodiment, the bond material can include a content of BaO of not greater than 0.6 wt % or not greater than 0.4 wt % or not greater than 0.2 wt % or not greater than 0.1 wt % or not greater than 0.05 wt % or not greater than 0.03 wt. % for a total content of the bond material.

In an embodiment, the bond material can include a content of CaO of at least 0.3 wt %. In an embodiment, the bond material can include a content of CaO of not greater than 2 wt % or not greater than 1.5 wt % or not greater than 1 wt % or not greater than 0.5 wt % for a total content of the bond material. It will be appreciated that the CaO content may be between any of the minimum and maximum values noted above.

In an embodiment, the bond material can include a content of CoO of not greater than 0.7 wt % for a total content of the bond material.

In an embodiment, the bond material can include a content of $Cr_2O_3$ of not greater than 0.01 wt % for a total content of the bond material.

In an embodiment, the bond material can include a content of $Fe_2O_3$ of not greater than 0.8 wt % or not greater than 0.7 wt % for a total content of the bond material.

In an embodiment, the bond material can include a content of CuO of not greater than 0.01 wt % for a total content of the bond material.

In an embodiment, the bond material can include a content of $HfO_2$ of not greater than 0.02 wt % for a total content of the bond material.

In an embodiment, the bond material can include a content of $K_2O$ of at least 0.5 wt %. In an embodiment, the bond material can include a content of $K_2O$ of not greater than 2 wt % or not greater than 1 wt % for a total content of the bond material. It will be appreciated that the $K_2O$ content may be between any of the minimum and maximum values noted above.

In an embodiment, the bond material can include a content of $La_2O_2$ of at least 1.3 wt %. In an embodiment, the bond material can include a content of $La_2O_2$ of not greater than 2.0 wt % or not greater than 1.5 wt % for a total content of the bond material. It will be appreciated that the $La_2O_2$ content may be between any of the minimum and maximum values noted above.

In an embodiment, the bond material can include a content of $Li_2O$ of at least 0.2 wt % or at least 0.5 wt % or at least 0.7 wt % or at least 0.9 wt %. In an embodiment, the bond material can include a content of $Li_2O$ of not greater than 3 wt % or not greater than 2.5 wt % or not greater than 2.0 wt % or not greater than 1.5 wt % or not greater than 1.1 wt % for a total content of the bond material. It will be appreciated that the $Li_2O$ content may be between any of the minimum and maximum values noted above.

In an embodiment, the bond material can include a content of MgO of at least 0.5 wt % or at least 0.7 wt %. In an embodiment, the bond material can include a content of MgO of not greater than 1.5 wt % or 1.0 wt % for a total content of the bond material. It will be appreciated that the MgO content may be between any of the minimum and maximum values noted above.

In an embodiment, the bond material can include a content of $MnO_2$ of not greater than 0.05 wt %. In an embodiment, the bond material can include a content of $MnO_2$ of not greater than 0.02 wt % for a total content of the bond material. It will be appreciated that the $MnO_2$ content may be between any of the minimum and maximum values noted above.

In an embodiment, the bond material can include a content of $Na_2O$ of at least 4 wt %. In an embodiment, the bond material can include a content of $Na_2O$ of not greater than 12 wt % or not greater than 9 wt % or not greater than 6 wt % for a total content of the bond material. It will be appreciated that the $Na_2O$ content may be between any of the minimum and maximum values noted above.

In an embodiment, the bond material can include a content of NiO of not greater than 0.01 wt % for a total content of the bond material.

In an embodiment, the bond material can include a content of SrO of not greater than 0.02 wt % for a total content of the bond material.

In an embodiment, the bond material can include a content of $TiO_2$ of at least 0.2 wt % and not greater than 0.8 wt % for a total content of the bond material.

In an embodiment, the bond material can include a content of $V_2O_5$ of not greater than 0.02 wt % for a total content of the bond material.

In an embodiment, the bond material can include a content of $Y_2O_3$ of at least 0.4 wt % and not greater than 1.0 wt % for a total content of the bond material.

In an embodiment, the bond material can include a content of ZnO of not greater than 0.2 wt % for a total content of the bond material.

In an embodiment, the bond material can include a content of $ZrO_2$ of not greater than 0.01 wt % for a total content of the bond material.

In accordance with one embodiment, the bond material may be added in a particular content. For example, in one embodiment abrasive article may include at least 1 vol % bond material for a total volume of the body or at least 2 vol % or at least 3 vol % or at least 4 vol % or at least 5 vol % or at least 6 vol % or at least 7 vol % or at least 8 vol % or at least 9 vol % or at least 10 vol % or at least 11 vol % or at least 12 vol % or at least 13 vol % or at least 14 vol % or at least 15 vol % or at least 16 vol % or at least 17 vol % or at least 18 vol % or at least 19 vol % or at least 20 vol % or at least 22 vol % or at least 24 vol % or at least 26 vol % or at least 28 vol % or at least 30 vol % or at least 32 vol % or at least 34 vol % or at least 36 vol % or at least 38 vol % or at least 40 vol % for a total volume of the body. In one embodiment abrasive article may include at least 1 wt % bond material for a total weight of the body or at least 2 wt % or at least 3 wt % or at least 4 wt % or at least 5 wt % or at least 6 wt % or at least 7 wt % or at least 8 wt % or at least 9 wt % or at least 10 wt % or at least 11 wt % or at least 12 wt % or at least 13 wt % or at least 14 wt % or at least 15 wt % or at least 16 wt % or at least 17 wt % or at least 18 wt % or at least 19 wt % or at least 20 wt % or at least 22 wt % or at least 24 wt % or at least 26 wt % or at least 28 wt % or at least 30 wt % or at least 32 wt % or at least 34 wt % or at least 36 wt % or at least 38 wt % or at least 40 wt % for a total weight of the body. Still, in one non-limiting embodiment, the abrasive article may include not greater than 50 vol % bond material for a total volume of the body or not greater than 48 vol % or not greater than 46 vol % or not greater than 44 vol % or not greater than 42 vol % or not greater than 40 vol % or not greater than 38 vol % or not greater than 36 vol % or not greater than 34 vol % or not greater than 32 vol % or not greater than 30 vol % or not greater than 28 vol % or not greater than 26 vol % or not greater than 24 vol % or not greater than 22 vol % or not greater than 20 vol % for a total volume of the body. In one non-limiting embodiment, the abrasive article may include not greater than 50 wt % bond material for a total weight of the body or not greater than 48 wt % or not greater than 46 wt % or not greater than 44 wt % or not greater than 42 wt % or not greater than 40 wt % or not greater than 38 wt % or not greater than 36 wt % or not greater than 34 wt % or not greater than 32 wt % or not greater than 30 wt % or not greater than 28 wt % or not greater than 26 wt % or not greater than 24 wt % or not greater than 22 wt % or not greater than 20 wt % for a total weight of the body. The abrasive article may include a content of the bond material in an amount within a range, including any of the minimum and maximum percentages noted above.

The abrasive article may further include abrasive particles configured to form the abrasive component of the final-formed abrasive article. The abrasive particles may be added to the abrasive article at various times, including, for example, after the addition of the bond material to the abrasive article. Still, it will be appreciated, in other embodiments, the abrasive particles may be added in combination with one or more of the other components in the abrasive article, including, for example, but not limited to the gelling agent, the bond material, or one or more additives. The abrasive particles may include a material such as from the group consisting of oxides, borides, nitrides, carbides, oxynitrides, oxycarbides, amorphous, monocrystalline, polycrystalline, superabrasive, diamond, or any combination thereof. In an embodiment, at least one material is from the group of alumina, silica, zirconia, or any combination thereof. In one particular embodiment, the abrasive particles can include alumina, and may consist essentially of alumina. In an embodiment, the abrasive particles comprise at least one of fused alumina, unseeded alumina, seeded sol-gel alumina, alumina with one or more magnetoplumbite-containing phases. In an embodiment, the abrasive particles can include doped alumina. In an embodiment, the abrasive particles can include La or MgO, or a combination thereof.

In an embodiment, the abrasive particles can include at least one of unshaped particles (e.g., crushed), shaped particles, agglomerated particles, unagglomerated particles.

The abrasive article may include a certain content of abrasive particles to facilitate improved manufacturing and/or improved performance of the abrasive article. For example, in one embodiment, the abrasive article may include at least 1 vol % abrasive particles for a total volume of the body or at least 5 vol % or at least 10 vol % or at least 15 vol % or at least 20 vol % or at least 25 vol % or at least 30 vol % or at least 32 vol % or at least 34 vol % or at least 36 vol % or at least 38 vol % or at least 40 vol % or at least 42 vol % or at least 44 vol % or at least 46 vol % or at least 48 vol % or at least 50 vol %. In another non-limiting embodiment, the abrasive article may include not greater than 80 vol % abrasive particles for a total volume of the body or not greater than 78 vol % or not greater than 76 vol % or not greater than 74 vol % or not greater than 72 vol % or not greater than 70 vol % or not greater than 68 vol % or not greater than 66 vol % or not greater than 64 vol % or not greater than 62 vol % or not greater than 60 vol % or not greater than 58 vol % or not greater than 56 vol % or not greater than 54 vol % or not greater than 52 vol % or not greater than 50 vol % for a total volume of the body. The abrasive article may include a content of the abrasive particles in an amount within a range, including any of the minimum and maximum percentages noted above.

In an embodiment, the abrasive particles can have a polycrystalline phase having crystalline domains, the crystalline domains having an average domain size of not greater than 8 microns or not greater than 7 microns or not greater than 6 microns or not greater than 5 microns or not greater than 4 microns or not greater than 3 microns or not greater than 2 microns or not greater than 1 micron or not greater than 0.5 microns or not greater than 0.3 microns according to the uncorrected intercept method. In an embodiment, the abrasive particles can have a polycrystalline phase having crystalline domains having an average domain size of at least 0.1 microns or at least 0.2 microns or at least 0.3 microns or at least 0.4 microns or at least 0.5 microns or at least 0.75 microns or at least 1 microns or at least 1.5 microns or at least 2 microns or at least 2.5 microns or at least 3 microns or at least 3.5 microns or at least 4 microns or at least 4.5 microns or at least 5 microns. It will be appreciated that the average crystalline domain size may be between any of the minimum and maximum values noted above.

The abrasive article can include a particular ratio of abrasive particles to bond content (APv/ABv) that may facilitate improved performance and/or manufacturing of the abrasive article. In an embodiment, APv/ABv can be at least 1 or at least 1.1 or at least 1.2 or at least 1.3 or at least 1.4 or at least 1.5 or at least 1.6 or at least 1.7 or at least 1.8 or at least 1.9 or at least 2.0 or at least 2.1 or at least 2.2 or at least 2.3 or at least 2.4 or at least 2.5 or at least 2.6. In an embodiment, APv/ABv can be not greater than 10 or not greater than 9 or not greater than 8 or not greater than 7 or not greater than 6 or not greater than 5 or not greater than 4.5 or not greater than 4.0 or not greater than 3.9 or not greater than 3.8 or not greater than 3.7 or not greater than 3.6 or not greater than 3.5 or not greater than 3.4 or not greater than 3.3 or not greater than 3.2 or not greater than 3.1 or not greater than 3.0. It will be appreciated that APv/ABv can be between any of the minimum and maximum values noted above.

In an embodiment, the abrasive particles can have a multimodal particle size distribution. An exemplary particle size distribution can be found in FIG. 3. The multimodal particle size distribution can have a fine mode and a coarse mode, and a midway point equal to the mean of the particle sizes corresponding to the fine mode and the coarse mode.

In an embodiment, the coarse mode can correspond to a particular particle size that may facilitate improved performance and/or manufacturing of the abrasive article. In an embodiment, the coarse mode can be at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns. In an embodiment the coarse mode can be not greater than 1000 microns or not greater than 800 microns or not greater than 600 microns or not greater than 500 microns or not greater than 400 microns or not greater than 300 microns or not greater than 200 microns or not greater than 190 microns or not greater than 185 microns or not greater than 180 microns or not greater than 175 microns or not greater than 170 microns or not greater than 165 microns or not greater than 160 microns or not greater than 155 microns or not greater than 150 microns or not greater than 145 microns or not greater than 140 microns or not greater than 135 microns or not greater than 130 microns or not greater than 125 microns or not greater than 120 microns or not greater than 115 microns or not greater than 110 microns or not greater than 105 microns or not greater than 100 microns or not greater than 95 microns or not greater than 90 microns or not greater than 85 microns or not greater than 80 microns or not greater than 75 microns or not greater than 70 microns. It will be appreciated that the coarse mode can be between any of the minimum and maximum values noted above.

In an embodiment, the fine mode can correspond to a particular particle size that may facilitate improved performance and/or manufacturing of the abrasive article. In an embodiment, the fine mode can be at least 1 micron or at least 2 microns or at least 3 microns or at least 4 microns or at least 5 microns or at least 6 microns or at least 7 microns or at least 8 microns or at least 9 microns or at least 10 microns or at least 11 microns or at least 12 microns or at least 13 microns or at least 14 microns or at least 15 microns or at least 16 microns or at least 17 microns or at least 18 microns or at least 19 microns or at least 20 microns or at least 21 microns or at least 22 microns or at least 23 microns or at least 24 microns or at least 25 microns or at least 26 microns or at least 27 microns or at least 28 microns. In an embodiment, the fine mode can be not greater than 80 microns or not greater than 78 microns or not greater than 76 microns or not greater than 74 microns or not greater than 72 microns or not greater than 70 microns or not greater than 68 microns or not greater than 66 microns or not greater than 64 microns or not greater than 62 microns or not greater than 60 microns or not greater than 58 microns or not greater than 56 microns or not greater than 54 microns or not greater than 52 microns or not greater than 50 microns or not greater than 48 microns or not greater than 46 microns or not greater than 44 microns or not greater than 42 microns or not greater than 40 microns or not greater than 38 microns or not greater than 36 microns or not greater than 34 microns or not greater than 32 microns or not greater than 30 microns. It will be appreciated that the fine mode can be between any of the minimum and maximum values noted above.

In an embodiment, the difference between the fine and coarse modes can correspond to a particular particle size that may facilitate improved performance and/or manufacturing of the abrasive article. In an embodiment, the difference between the fine and coarse modes can be at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns. In an embodiment the difference between the fine and coarse modes can be not greater than 1000 microns or not greater than 800 microns or not greater than 600 microns or not greater than 500 microns or not greater than 400 microns or not greater than 300 microns or not greater than 200 microns or not greater than 190 microns or not greater than 185 microns or not greater than 180 microns or not greater than 175 microns or not greater than 170 microns or not greater than 165 microns or not greater than 160 microns or not greater than 155 microns or not greater than 150 microns or not greater than 145 microns or not greater than 140 microns or not greater than 135 microns or not greater than 130 microns or not greater than 125 microns or not greater than 120 microns or not greater than 115 microns or not greater than 110 microns or not greater than 105 microns or not greater than 100 microns or not greater than 95 microns or not greater than 90 microns or not greater than 85 microns or not greater than 80 microns or not greater than 75 microns or not greater than 70 microns. It will be appreciated that the difference between the fine and coarse modes can be between any of the minimum and maximum values noted above.

In an embodiment, the multimodal particle size distribution can include vol % ratio, [Vc/Vf] wherein Vc represents the vol % of the coarse abrasive particles having a particle size above the mean of the fine mode and the coarse mode and Vf represents the vol % of abrasive particles having a particle size below the mean of the fine mode and the coarse mode. In an embodiment, [Vc/Vf] can be at least 0.5 or at least 0.6 or at least 0.7 or at least 0.8 or at least 0.9 or at least 1 or at least 1.1 or at least 1.2 or at least 1.3 or at least 1.4 or at least 1.5 or at least 2 or at least 3 or at least 4 or at least 5 or at least 6 or at least 7 or at least 8. In an embodiment [Vc/Vf] can be not greater than 100 or not greater than 75 or not greater than 50 or not greater than 40 or not greater than 30 or not greater than 20 or not greater than 15 or not greater than 12 or not greater than 10 or not greater than 9 or not greater than 8 or not greater than 7 or not greater than 6 or not greater than 5.

Bonded abrasive bodies formed by the processes of the embodiments herein may have particular features.

Figure 2A:
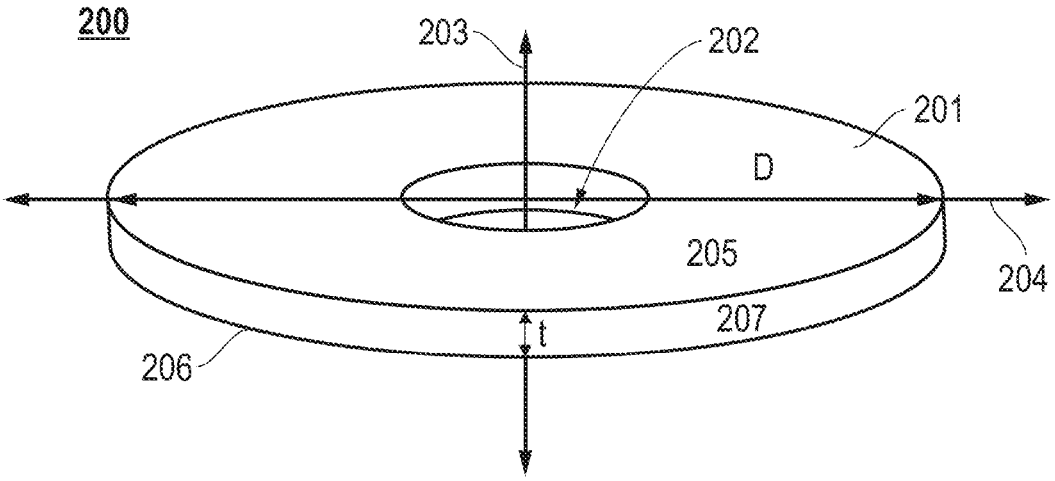
FIG. 2A includes a perspective-view illustration of an abrasive article according to an embodiment.

FIG. 2A includes a perspective view image of a bonded abrasive body in accordance with an embodiment. The abrasive article 200 can include a bonded abrasive body 201. The bonded abrasive body 201 can include an aperture 202. As further illustrated in FIG. 2A, the bonded abrasive body includes an axial axis 203 defining an axial direction and a lateral axis 204 defining an axis in a radial direction. The axial axis 203 extends in the vertical direction as defined by a thickness (t) of the bonded abrasive body 201. The lateral axis 204 extends in a radial direction defining the radius or outer diameter (OD) of the bonded abrasive body 201. The body can have an inner diameter (ID) corresponding to the diameter of the aperture 202 in the center of the body. The body may have a first major surface 205, a second major surface 206 opposite the first major surface and separated by thickness t, and a side surface 207 extending between the first major surface and the second major surface.

In an embodiment, the abrasive article can have a particular OD that may facilitate improved performance or manufacturing of the abrasive article. In an embodiment, the OD can be at least 155 mm or at least 160 mm or at least 165 mm or at least 170 mm or at least 175 mm or at least 180 mm or at least 190 mm or at least 210 mm or at least 220 mm or at least 230 mm or at least 240 mm or at least 250 mm or at least 260 mm. In an embodiment, the OD can be not greater than 500 mm or not greater than 475 mm or not greater than 450 mm or not greater than 425 mm or not greater than 400 mm or not greater than 380 mm or not greater than 360 mm or not greater than 340 mm or not greater than 320 mm or not greater than 300 mm or not greater than 280 mm. It will be appreciated that the OD can be between any of the minimum or maximum values noted above.

In an embodiment, the abrasive article can have a particular ID that may facilitate improved performance or manufacturing of the abrasive article. In an embodiment, the ID can be at least 100 mm or at least 110 mm or at least 120 mm or at least 130 mm or at least 140 mm or at least 150 mm or at least 155 mm or at least 160 mm or at least 165 mm or at least 170 mm or at least 175 mm or at least 180 mm or at least 190 mm or at least 210 mm or at least 220 mm or at least 230 mm or at least 240 mm or at least 250 mm or at least 260 mm. In an embodiment, the ID can be not greater than 350 mm or not greater than 340 mm or not greater than 330 mm or not greater than 320 mm or not greater than 310 mm or not greater than 300 mm or not greater than 290 mm or not greater than 280 mm or not greater than 270 mm or not greater than 260 mm or not greater than 250 mm or not greater than 240 mm or not greater than 230 mm or not greater than 220 mm or not greater than 210 mm or not greater than 200 mm or not greater than 190 mm or not greater than 180 mm. It will be appreciated that the ID can be between any of the minimum or maximum values noted above In an embodiment, the abrasive article can have a particular thickness that may facilitate improved performance or manufacturing of the abrasive article. In an embodiment, the thickness can be at least 10 mm or at least 11 mm or at least 12 mm or at least 13 mm or at least 14 mm or at least 15 mm or at least 16 mm or at least 17 mm or at least 18 mm or at least 19 mm or at least 20 mm. In an embodiment, the thickness can be not greater than 100 mm or not greater than 95 mm or not greater than 90 mm or not greater than 85 mm or not greater than 80 mm or not greater than 75 mm or not greater than 70 mm or not greater than 65 mm or not greater than 60 mm or not greater than 55 mm or not greater than 50 mm or not greater than 45 mm or not greater than 40 mm or not greater than 35 mm or not greater than 30 mm. It will be appreciated that the thickness can be between any of the minimum or maximum values noted above.

Figure 2B:
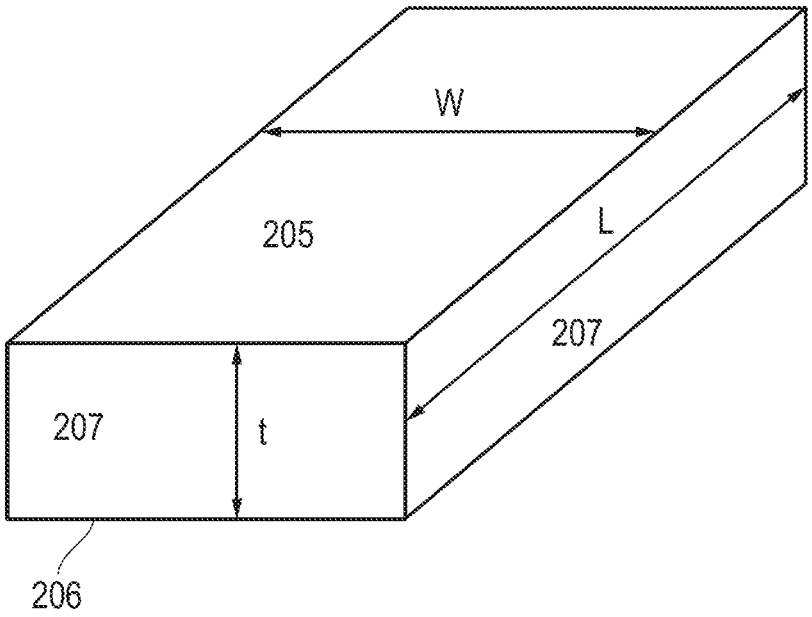
FIG. 2B includes a perspective-view illustration of an abrasive article according to an embodiment.

FIG. 2B includes a perspective view image of a bonded abrasive body in accordance with a different embodiment. The abrasive article 200 can include a bonded abrasive body 201. The body can include a length (L), a width (W), and a thickness (t), where the thickness (t) is the shortest dimension. The body may have a first major surface 205, a second major surface 206 opposite the first major surface and separated by thickness t, and side surfaces 207 extending between the first major surface and the second major surface.

The porosity of the bonded abrasive body 201 may include open porosity, closed porosity, or a combination thereof. Open porosity can be defined as interconnected channels extending through the bonded abrasive body 201. Closed porosity can define discrete and isolated voids contained in the bond material.

In an embodiment, the abrasive article can include a particular content of porosity that may facilitate improved performance and/or manufacturing of the abrasive article. In an embodiment, the abrasive article can include a content of porosity of at least 1 vol % or at least 2 vol % or at least 3 vol % or at least 4 vol % or at least 5 vol % or at least 6 vol % or at least 7 vol % or at least 8 vol % or at least 9 vol % or at least 10 vol % or at least 11 vol % or at least 12 vol % or at least 13 vol % or at least 14 vol % or at least 15 vol % or at least 16 vol % or at least 17 vol % or at least 18 vol % or at least 19 vol % or at least 20 vol % or at least 21 vol % or at least 22 vol % or at least 23 vol % or at least 24 vol % or at least 25 vol % or at least 26 vol % or at least 27 vol % or at least 28 vol % or at least 29 vol % or at least 30 vol %. In an embodiment, the abrasive article can include a content of porosity of not greater than 65 vol % for a total volume of the body or not greater than 60 vol % or not greater than 55 vol % or not greater than 50 vol % or not greater than 48 vol % or not great than 46 vol % or not great than 44 vol % or not great than 42 vol % or not great than 40 vol % or not great than 38 vol % or not great than 36 vol % or not great than 34 vol % or not great than 32 vol % or not great than 30 vol % for a total volume of the body. It will be appreciated that the porosity content may be between any of the minimum and maximum values noted above.

In an embodiment, the abrasive article can include a particular density that may facilitate improved performance and/or manufacturing of the abrasive article. In an embodiment, the abrasive article can include a density of at least 2.10 g/cm$^3$ or at least 2.15 g/cm$^3$ or at least 2.20 g/cm$^3$ or at least 2.25 g/cm$^3$ or at least 2.3 g/cm$^3$ or at least 2.35 g/cm$^3$. In an embodiment, the abrasive article can include a density of not greater than 2.60 g/cm$^3$ or not greater than 2.55 g/cm$^3$. It will be appreciated that the density may be between any of the minimum and maximum values noted above.

In an embodiment, the abrasive article can include a particular density variation that may facilitate improved performance and/or manufacturing of the abrasive article. The density variation can be measured according to the process outlined in the examples. In an embodiment, the abrasive article can include a density variation of not greater than 0.040 g/cm$^3$ or not greater than 0.035 g/cm$^3$ or not greater than 0.030 g/cm$^3$ or not greater than 0.025 g/cm$^3$ or not greater than 0.022 g/cm$^3$ or not greater than 0.020 g/cm$^3$ or not greater than 0.019 g/cm$^3$ or not greater than 0.018 g/cm$^3$ or not greater than 0.017 g/cm$^3$ or not greater than 0.016 g/cm$^3$ or not greater than 0.015 g/cm$^3$ or not greater than 0.014 g/cm$^3$ or not greater than 0.013 g/cm$^3$ or not greater than 0.012 g/cm$^3$ or not greater than 0.011 g/cm$^3$ or not greater than 0.010 g/cm$^3$. In an embodiment, the abrasive article can include a density variation of at least 0.0001 g/cm$^3$ or at least 0.0005 g/cm$^3$ or at least 0.001 g/cm$^3$ or at least 0.005 g/cm$^3$.

In an embodiment, the abrasive article can have a particular MOR that may facilitate improved performance and/or manufacturing of the abrasive article. MOR can be measured as explained in the examples section of this publication. In an embodiment, the MOR can be at least 55 MPa or at least 56 MPa or at least 57 MPa or at least 58 MPa or at least 59 MPa or at least 60 MPa or at least 61 MPa or at least 62 MPa or at least 63 MPa or at least 64 MPa or at least 65 MPa or at least 66 MPa or at least 67 MPa or at least 68 MPa or at least 69 MPa or at least 70 MPa or at least 71 MPa or at least 72 MPa or at least 73 MPa or at least 74 MPa or at least 75 MPa or at least 76 MPa or at least 77 MPa or at least 78 MPa or at least 79 MPa or at least 80 MPa. In another embodiment, the MOR can be not greater than 120 MPa or not greater than 119 MPa or not greater than 118 MPa or not greater than 117 MPa or not greater than 116 MPa or not greater than 115 MPa or not greater than 114 MPa or not greater than 113 MPa or not greater than 112 MPa or not greater than 111 MPa or not greater than 110 MPa or not greater than 109 MPa or not greater than 108 MPa or not greater than 107 MPa or not greater than 106 MPa or not greater than 105 MPa or not greater than 104 MPa or not greater than 103 MPa or not greater than 102 MPa or not greater than 101 MPa or not greater than 100 MPa or not greater than 99 MPa or not greater than 98 MPa or not greater than 97 MPa or not greater than 96 MPa or not greater than 95 MPa or not greater than 94 MPa or not greater than 93 MPa or not greater than 92 MPa or not greater than 91 MPa or not greater than 90 MPa or not greater than 89 MPa or not greater than 88 MPa or not greater than 87 MPa or not greater than 86 MPa or not greater than 85 MPa or not greater than 84 MPa or not greater than 83 MPa or not greater than 82 MPa or not greater than 81 MPa or not greater than 80 MPa or not greater than 79 MPa or not greater than 78 MPa or not greater than 77 MPa or not greater than 76 MPa or not greater than 75 MPa or not greater than 74 MPa or not greater than 73 MPa or not greater than 72 MPa or not greater than 71 MPa or not greater than 70 MPa or not greater than 69 MPa or not greater than 68 MPa. It will be appreciated that the MOR may be between any of the minimum and maximum values noted above.

In an embodiment, the abrasive article can have a particular MOE (or EMOD) that may facilitate improved performance and/or manufacturing of the abrasive article. MOE can be measured as explained in the examples section of this publication. In an embodiment, the MOE can be at least 55 GPa or at least 56 GPa or at least 57 GPa or at least 58 GPa or at least 59 GPa or at least 60 GPa or at least 61 GPa or at least 62 GPa or at least 63 GPa or at least 64 GPa or at least 65 GPa or at least 66 GPa or at least 67 GPa or at least 68 GPa or at least 69 GPa or at least 70 GPa or at least 71 GPa or at least 72 GPa or at least 73 GPa or at least 74 GPa or at least 75 GPa or at least 76 GPa or at least 77 GPa or at least 78 GPa or at least 79 GPa or at least 80 GPa. In another embodiment, the MOE can not greater than 90 GPa or not greater than 89 GPa or not greater than 88 GPa or not greater than GPa 87 GPa or not greater than 86 GPa or not greater than 85 GPa or not greater than 84 GPa or not greater than 83 GPa or not greater than 82 GPa or not greater than 81 GPa or not greater than 80 GPa or not greater than 79 GPa or not greater than 78 GPa or not greater than 77 GPa or not greater than 76 GPa or not greater than 75 GPa or not greater than 74 GPa or not greater than 73 GPa or not greater than 72 GPa or not greater than 71 GPa or not greater than 70 GPa or not greater than 69 GPa or not greater than 68 GPa or not greater than 67 GPa or not greater than 66 GPa or not greater than 65 GPa or not greater than 64 GPa or not greater than 63 GPa or not greater than 62 GPa or not greater than 61 GPa or not greater than 60 GPa. It will be appreciated that the MOE may be between any of the minimum and maximum values noted above.

In an embodiment, the abrasive article can have a particular MOR/MOE that may facilitate improved performance and/or manufacturing of the abrasive article. In an embodiment, the MOR/MOE can be at least 0.91 or at least 0.92 or at least 0.93 or at least 0.94 or at least 0.95 or at least 0.96 or at least 0.97 or at least 0.98 or at least 0.99 or at least 1.00 or at least 1.01 or at least 1.02 or at least 1.03 or at least 1.04 or at least 1.05 or at least 1.06 or at least 1.07 or at least 1.08 or at least 1.09 or at least 1.1 or at least 1.11 or at least 1.12 or at least 1.13 or at least 1.14 or at least 1.15 or at least 1.16 or at least 1.17 or at least 1.18 or at least 1.19 or at least 1.2 or at least 1.21 or at least 1.22 or at least 1.23 or at least 1.24 or at least 1.25 or at least 1.26 or at least 1.27 or at least 1.28 or at least 1.29 or at least 1.3. In another embodiment, the MOR/MOE can be not greater than 2 or not greater than 1.95 or not greater than 1.9 or not greater than 1.85 or not greater than 1.8 or not greater than 1.75 or not greater than 1.7 or not greater than 1.65 or not greater than 1.6 or not greater than 1.55 or not greater than 1.5 or not greater than 1.45 or not greater than 1.4 or not greater than 1.35 or not greater than 1.3 or not greater than 1.25 or not greater than 1.2 or not greater than 1.15 or not greater than 1.14 or not greater than 1.13 or not greater than 1.12 or not greater than 1.11 or not greater than 1.10 or not greater than 1.09 or not greater than 1.08. It will be appreciated that the MOR/MOE may be between any of the minimum and maximum values noted above.

In an embodiment, the preferred MOR/MOE ratio may depend in part upon the bond vol % of the abrasive article. When the bond vol % of the abrasive article is at least 18% the MOR/MOE ratio may be at least 0.92. When the bond vol % of the abrasive article is at less than 18%, or within a range 18-14 vol % the MOR/MOE ratio may be at least 1.05.

Figure 4A:
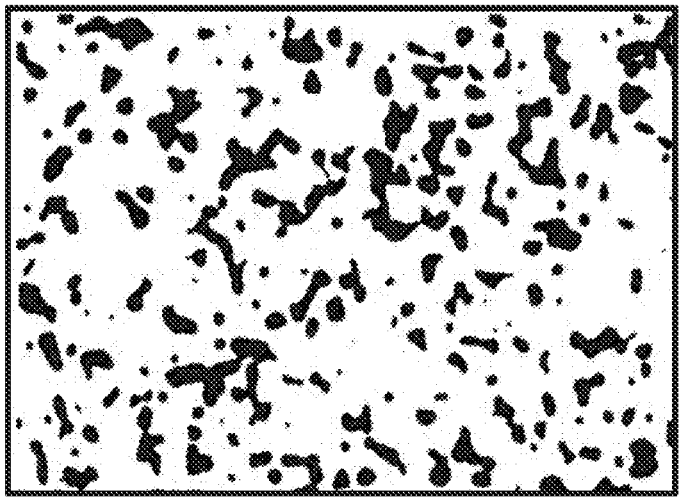
FIG. 4A includes an SEM image of a bond microstructure of an abrasive article according to an embodiment.
Figure 4B:
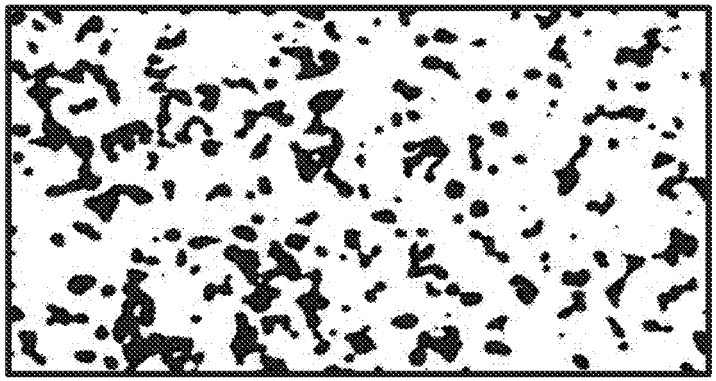
FIGS. 4B and 4C include SEM images of a bond microstructure of an abrasive article according to commercial samples.
Figure 4C:
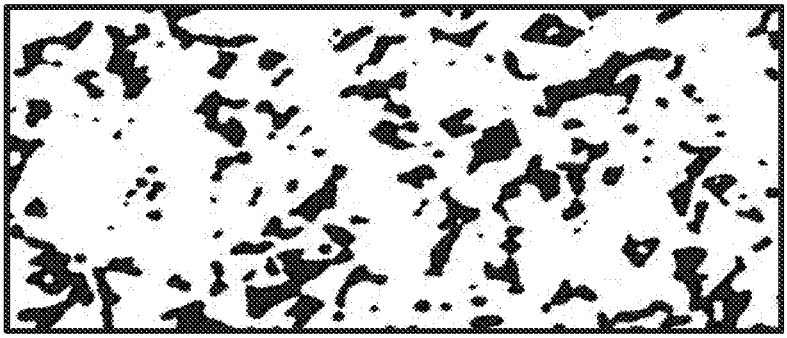

In an embodiment, the abrasive article can include a particular average bond post area (BPA) that may facilitate improved performance and/or manufacturing of the abrasive article. Bond post area can be measured as explained in the examples. Exemplary images used to measure bond post area and counts can be found in FIGS. 4A-C. The dark spots correspond to the bond posts. In an embodiment, average BPA can be not greater 2400 micron$^2$ or not greater than 2300 micron$^2$ or not greater than 2200 micron$^2$ or not greater than 2100 micron$^2$ or not greater than 2000 micron$^2$ or not greater than 1900 micron$^2$ or not greater than 1875 micron$^2$ or not greater than 1850 micron$^2$ or not greater than 1825 micron$^2$ or not greater than 1800 micron$^2$ or not greater than 1775 micron$^2$ or not greater than 1750 micron$^2$ or not greater than 1730 micron$^2$. In an embodiment, average BPA can be at least 1000 micron$^2$ or at least 1100 micron$^2$ or at least 1200 micron$^2$ or at least 1300 micron$^2$ or at least 1400 micron$^2$ or at least 1500 micron$^2$ or at least 1600 micron$^2$. It will be appreciated that the average BPA may be between any of the minimum and maximum values noted above.

In an embodiment, the abrasive article can include a particular bond post area (BPA) per bond vol % that may facilitate improved performance and/or manufacturing of the abrasive article. In an embodiment, BPA per bond vol % can be not greater than 200 micron$^2$ or not greater than 195 micron$^2$ or not greater than 190 micron$^2$ or not greater than 185 micron$^2$ or not greater than 180 micron$^2$ or not greater than 175 micron$^2$ or not greater than 170 micron$^2$ or not greater than 165 micron$^2$ or not greater than 160 micron$^2$ or not greater than 155 micron$^2$ or not greater than 150 micron$^2$ or not greater than 145 micron$^2$ or not greater than 140 micron$^2$ or not greater than 135 micron$^2$ or not greater than 130 micron$^2$ per bond vol %. In an embodiment, BPA per bond vol % can be at least 60 micron$^2$ or at least 70 micron$^2$ or at least 80 micron$^2$ or at least 90 micron$^2$ or at least 100 micron$^2$ or at least 110 micron$^2$ or at least 120 micron$^2$ or at least 130 micron$^2$ per bond vol %. It will be appreciated that the BPA per bond vol % may be between any of the minimum and maximum values noted above.

In an embodiment, the abrasive article can include a particular bond post volume (BPV) per bond vol % that may facilitate improved performance and/or manufacturing of the abrasive article. In an embodiment, BPV per bond vol % can be 6000 micron$^3$ or not greater than 5500 micron$^3$ or not greater than 5100 micron$^3$ or not greater than 5000 micron$^3$ or not greater than 4900 micron$^3$ or not greater than 4800 micron$^3$ or not greater than 4700 micron$^3$ or not greater than 4600 micron$^3$ or not greater than 4500 micron$^3$ or not greater than 4400 micron$^3$ or not greater than 4300 micron$^3$ or not greater than 4200 micron$^3$ or not greater than 4100 micron$^3$ or not greater than 4000 micron$^3$ or not greater than 3900 micron$^3$ per bond vol %. In an embodiment, BPV per bond vol % can be at least 3100 micron$^3$ or at least 3200 micron$^3$ or at least 3300 micron$^3$ or at least 3400 micron$^3$ or at least 3500 micron$^3$ or at least 3600 micron$^3$ per bond vol %. It will be appreciated that the BPV per bond vol % may be between any of the minimum and maximum values noted above.

In an embodiment, the abrasive article can include a particular bond post count (BPC) per 1.536 $mm^2$ that may facilitate improved performance and/or manufacturing of the abrasive article. Bond post count can be measured as explained in the examples. Exemplary images used to measure bond post count and counts can be found in FIGS. 4A-C. The dark spots correspond to the bond posts. In an embodiment, BPC per 1.536 $mm^2$ can be at least 140 or at least 150 or at least 160 or at least 165 or at least 170 or at least 175 or at least 180 or at least 185. In an embodiment, BPC per 1.536 $mm^2$ can be not greater than 300 or not greater than 275 or not greater than 250 or not greater than 225. It will be appreciated that the BPC per 1.536 $mm^2$ may be between any of the minimum and maximum values noted above.

In an embodiment, the abrasive article can include a particular bond post count (BPC) bond posts per 1.536 $mm^2$ per bond vol % that may facilitate improved performance and/or manufacturing of the abrasive article. In an embodiment, BPC bond posts per 1.536 $mm^2$ per bond vol % can be at least 7.5 or at least 7.6 or at least 7.7 or at least 7.8 or at least 7.9 or at least 8.0 or at least 8.1 or at least 8.2 or at least 8.3 or at least 8.4 or at least 8.5 bond posts per 1.536 $mm^2$ per bond vol %. In an embodiment, BPC bond posts per 1.536 $mm^2$ per bond vol % can be not greater than 10 or not greater than 9.9 or not greater than 9.8 or not greater than 9.7 or not greater than 9.6 or not greater than 9.5 bond posts per 1.536 $mm^2$ per bond vol %. It will be appreciated that the BPC bond posts per 1.536 $mm^2$ per bond vol % may be between any of the minimum and maximum values noted above.

In an embodiment, the abrasive article can have a particular cumulative bond post area distribution. The distribution can include a bond post area on the x-axis, and a number of bond posts as or below that area on the y-axis. Exemplary cumulative bond post area distributions can be found in FIG. 5. In an embodiment, the abrasive article can have a $10^{th}$ percentile bond post area of at least 115 $micron^2$ and not greater than 125 $micron^2$. In an embodiment the abrasive article can have a $25^{th}$ percentile bond post area of at least 300 $micron^2$ and not greater than 310 $micron^2$. In an embodiment the abrasive article can have a $50^{th}$ percentile bond post area of at least 715 $micron^2$ and not greater than 735 $micron^2$. In an embodiment the abrasive article can have a $75^{th}$ percentile bond post area of at least 1800 $micron^2$ and not greater than 1900 $micron^2$. In an embodiment the abrasive article can have a $90^{th}$ percentile bond post area of at least 3500 $micron^2$ and not greater than 4000 $micron^2$.

Figure 6:
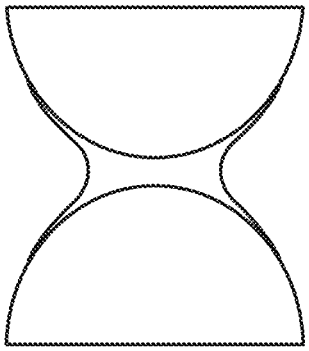
FIG. 6 includes an illustration of an exemplary bond post with a high wetting bond material.
Figure 7:
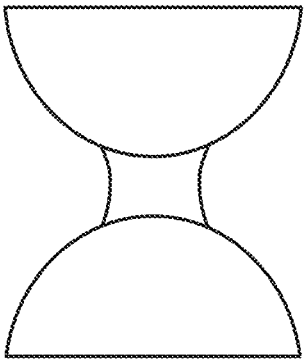
FIG. 7 includes an illustration of an exemplary bond post with a low wetting bond material.
Figure 8:
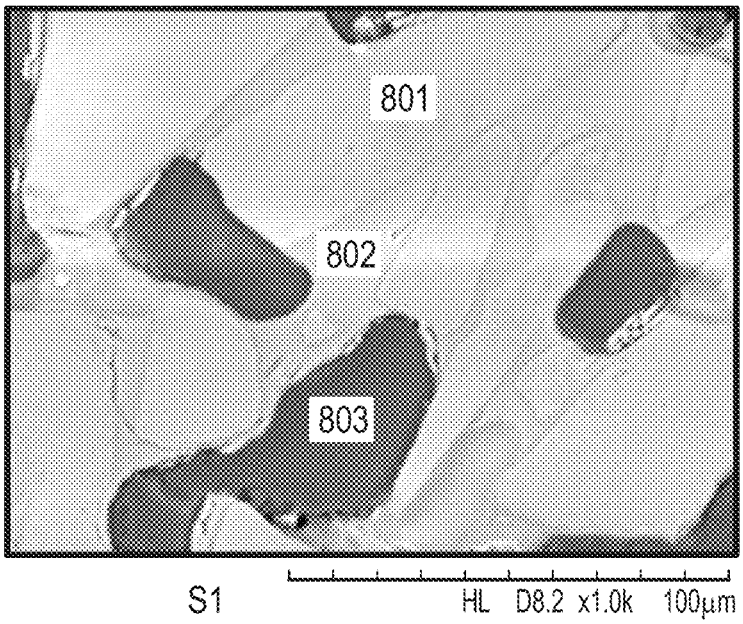
FIG. 8 includes an image of bond posts and porosity in an embodiment.

In an embodiment, the abrasive article can have bond posts with a particular average radius of curvature or bond wetting radius. The radius of curvature of the bond posts is indicative of the bond materials wetting ability. Bond materials with high wetting will have bond posts with low radii of curvature, such as shown in FIG. 6. Bond materials with low wetting will have bond posts with large radii of curvature, such as shown in FIG. 7. Bond post curvature radii can be measured as described in the examples from images such as those shown in FIG. 8. FIG. 8 includes an image of an abrasive article with particles 801, bond material 802, and porosity 803.

In an embodiment, the abrasive article can include bond posts with a particular average bond wetting radius. In an embodiment, the average bond wetting radius can be at least 30 microns or at least 31 microns or at least 32 microns or at least 33 microns or at least 34 microns or at least 35 microns or at least 36 microns or at least 37 microns or at least 38 microns or at least 39 microns or at least 40 microns. In an embodiment, the average bond wetting radius can be not greater than 100 microns or not greater than 90 microns or not greater than 80 microns or not greater than 70 microns or not greater than 60 microns or not greater than 50 microns or not greater than 40 microns. It will be appreciated that the bond wetting radius may be between any of the minimum and maximum values noted above.

The abrasive articles disclosed herein may be used for cutting, beveling, sharpening, gear power honing, worm gear grinding, CMR, stock removal, grinding, weld blending, or precision finishing.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1. An abrasive article comprising:
a body comprising:
a bond material comprising an inorganic material;
abrasive particles contained in a bond material;
a MOR/EMOD ratio of at least 0.92; a bond vol % of less than 18% and wherein the body further comprises at least one of:
a) an average Bond Post Area (BPA) of not greater than 2400 $microns^2$;
b) an average Bond Post Count (BPC) of at least 140 per 1.536 $mm^2$;
c) an average bond wetting radius of at least 30 microns; and
d) a combination of a) and b).

Embodiment 2. An abrasive article comprising:
a body comprising:
a bond material comprising an inorganic material;
abrasive particles contained in a bond material;
a MOR/EMOD ratio of at least 1.05; a bond vol % of at least 18% and not greater than 30% and wherein the body further comprises at least one of:
a) an average Bond Post Area (BPA) of not greater than 2400 $microns^2$;
b) an average Bond Post Count (BPC) of at least 140 per 1.536 $mm^2$;
c) an average bond wetting radius of at least 30 microns; and
d) a combination of a) and b).

Embodiment 3. The abrasive article of Embodiment 1 or Embodiment 2, wherein the body comprises a MOR/EMOD ratio of at least 0.91 or at least 0.92 or at least 0.93 or at least 0.94 or at least 0.95 or at least 0.96 or at least 0.97 or at least 0.98 or at least 0.99 or at least 1.00 or at least 1.01 or at least 1.02 or at least 1.03 or at least 1.04 or at least 1.05 or at least 1.06 or at least 1.07 or at least 1.08 or at least 1.09 or at least 1.1 or at least 1.11 or at least 1.12 or at least 1.13 or at least 1.14 or at least 1.15 or at least 1.16 or at least 1.17 or at least 1.18 or at least 1.19 or at least 1.2 or at least 1.21 or at least 1.22 or at least 1.23 or at least 1.24 or at least 1.25 or at least 1.26 or at least 1.27 or at least 1.28 or at least 1.29 or at least 1.3.

Embodiment 4. The abrasive article of Embodiment 1 or Embodiment 2, wherein the body comprises a MOR/EMOD ratio of not greater than 2 or not greater than 1.95 or not greater than 1.9 or not greater than 1.85 or not greater than 1.8 or not greater than 1.75 or not greater than 1.7 or not greater than 1.65 or not greater than 1.6 or not greater than 1.55 or not greater than 1.5 or not greater than 1.45 or not greater than 1.4 or not greater than 1.35 or not greater than 1.3 or not greater than 1.25 or not greater than 1.2 or not greater than 1.15 or not greater than 1.14 or not greater than 1.13 or not greater than 1.12 or not greater than 1.11 or not greater than 1.10 or not greater than 1.09 or not greater than 1.08.

Embodiment 5. The abrasive article of Embodiment 1 or Embodiment 2, wherein the body comprises a MOR of at least 55 MPa or at least 56 MPa or at least 57 MPa or at least 58 MPa or at least 59 MPa or at least 60 MPa or at least 61 MPa or at least 62 MPa or at least 63 MPa or at least 64 MPa or at least 65 MPa or at least 66 MPa or at least 67 MPa or at least 68 MPa or at least 69 MPa or at least 70 MPa or at least 71 MPa or at least 72 MPa or at least 73 MPa or at least 74 MPa or at least 75 MPa or at least 76 MPa or at least 77 MPa or at least 78 MPa or at least 79 MPa or at least 80 MPa.

Embodiment 6. The abrasive article of Embodiment 1 or Embodiment 2, wherein the body comprises a MOR of not greater than 120 MPa or not greater than 119 MPa or not greater than 118 MPa or not greater than 117 MPa or not greater than 116 MPa or not greater than 115 MPa or not greater than 114 MPa or not greater than 113 MPa or not greater than 112 MPa or not greater than 111 MPa or not greater than 110 MPa or not greater than 109 MPa or not greater than 108 MPa or not greater than 107 MPa or not greater than 106 MPa or not greater than 105 MPa or not greater than 104 MPa or not greater than 103 MPa or not greater than 102 MPa or not greater than 101 MPa or not greater than 100 MPa or not greater than 99 MPa or not greater than 98 MPa or not greater than 97 MPa or not greater than 96 MPa or not greater than 95 MPa or not greater than 94 MPa or not greater than 93 MPa or not greater than 92 MPa or not greater than 91 MPa or not greater than 90 MPa or not greater than 89 MPa or not greater than 88 MPa or not greater than 87 MPa or not greater than 86 MPa or not greater than 85 MPa or not greater than 84 MPa or not greater than 83 MPa or not greater than 82 MPa or not greater than 81 MPa or not greater than 80 MPa or not greater than 79 MPa or not greater than 78 MPa or not greater than 77 MPa or not greater than 76 MPa or not greater than 75 MPa or not greater than 74 MPa or not greater than 73 MPa or not greater than 72 MPa or not greater than 71 MPa or not greater than 70 MPa or not greater than 69 MPa or not greater than 68 MPa.

Embodiment 7. The abrasive article of Embodiment 1 or Embodiment 2, wherein the body comprises a EMOD of at least 55 GPa or at least 56 GPa or at least 57 GPa or at least 58 GPa or at least 59 GPa or at least 60 GPa or at least 61 GPa or at least 62 GPa or at least 63 GPa or at least 64 GPa or at least 65 GPa or at least 66 GPa or at least 67 GPa or at least 68 GPa or at least 69 GPa or at least 70 GPa or at least 71 GPa or at least 72 GPa or at least 73 GPa or at least 74 GPa or at least 75 GPa or at least 76 GPa or at least 77 GPa or at least 78 GPa or at least 79 GPa or at least 80 GPa.

Embodiment 8. The abrasive article of Embodiment 1 or Embodiment 2, wherein the body comprises a EMOD of not greater than 90 GPa or not greater than 89 GPa or not greater than 88 GPa or not greater than GPa 87 GPa or not greater than 86 GPa or not greater than 85 GPa or not greater than 84 GPa or not greater than 83 GPa or not greater than 82 GPa or not greater than 81 GPa or not greater than 80 GPa or not greater than 79 GPa or not greater than 78 GPa or not greater than 77 GPa or not greater than 76 GPa or not greater than 75 GPa or not greater than 74 GPa or not greater than 73 GPa or not greater than 72 GPa or not greater than 71 GPa or not greater than 70 GPa or not greater than 69 GPa or not greater than 68 GPa or not greater than 67 GPa or not greater than 66 GPa or not greater than 65 GPa or not greater than 64 GPa or not greater than 63 GPa or not greater than 62 GPa or not greater than 61 GPa or not greater than 60 GPa.

Embodiment 9. The abrasive article of Embodiment 1 or Embodiment 2, further comprising an average Bond Post Area (BPA) of not greater 2400 micron$^2$ or not greater than 2300 micron$^2$ or not greater than 2200 micron$^2$ or not greater than 2100 micron$^2$ or not greater than 2000 micron$^2$ or not greater than 1900 micron$^2$ or not greater than 1875 micron$^2$ or not greater than 1850 micron$^2$ or not greater than 1825 micron$^2$ or not greater than 1800 micron$^2$ or not greater than 1775 micron$^2$ or not greater than 1750 micron$^2$ or not greater than 1730 micron$^2$.

Embodiment 10. The abrasive article of Embodiment 1 or Embodiment 2, further comprising an average Bond Post Area (BPA) of at least 1000 micron$^2$ or at least 1100 micron$^2$ or at least 1200 micron$^2$ or at least 1300 micron$^2$ or at least 1400 micron$^2$ or at least 1500 micron$^2$ or at least 1600 micron$^2$.

Embodiment 11. The abrasive article of Embodiment 1 or Embodiment 2, further comprising an average Bond Post Area (BPA) per vol % bond material of not greater than 200 micron$^2$ or not greater than 195 micron$^2$ or not greater than 190 micron$^2$ or not greater than 185 micron$^2$ or not greater than 180 micron$^2$ or not greater than 175 micron$^2$ or not greater than 170 micron$^2$ or not greater than 165 micron$^2$ or not greater than 160 micron$^2$ or not greater than 155 micron$^2$ or not greater than 150 micron$^2$ or not greater than 145 micron$^2$ or not greater than 140 micron$^2$ or not greater than 135 micron$^2$ or not greater than 130 micron$^2$ per bond vol %.

Embodiment 12. The abrasive article of Embodiment 1 or Embodiment 2, further comprising an average Bond Post Area (BPA) per vol % bond material of at least 60 micron$^2$ or at least 70 micron$^2$ or at least 80 micron$^2$ or at least 90 micron$^2$ or at least 100 micron$^2$ or at least 110 micron$^2$ or at least 120 micron$^2$ or at least 130 micron$^2$ per bond vol %.

Embodiment 13. The abrasive article of Embodiment 1 or Embodiment 2, further comprising an average Bond Post Volume (BPV) per vol % bond material of not greater than 6000 micron$^3$ or not greater than 5500 micron$^3$ or not greater than 5100 micron$^3$ or not greater than 5000 micron$^3$ or not greater than 4900 micron$^3$ or not greater than 4800 micron$^3$ or not greater than 4700 micron$^3$ or not greater than 4600 micron$^3$ or not greater than 4500 micron$^3$ or not greater than 4400 micron$^3$ or not greater than 4300 micron$^3$ or not greater than 4200 micron$^3$ or not greater than 4100 micron$^3$ or not greater than 4000 micron$^3$ or not greater than 3900 micron$^3$ per bond vol %.

Embodiment 14. The abrasive article of Embodiment 1 or Embodiment 2, further comprising an average Bond Post Volume (BPV) per vol % bond material of at least 3100 micron$^3$ or at least 3200 micron$^3$ or at least 3300 micron$^3$ or at least 3400 micron$^3$ or at least 3500 micron$^3$ or at least 3600 micron$^3$ per bond vol %.

Embodiment 15. The abrasive article of Embodiment 1 or Embodiment 2, further comprising an average Bond Post Count (BPC) of at least 140 or at least 150 or at least 160 or at least 165 or at least 170 or at least 175 or at least 180 or at least 185 bond posts per 1.536 mm$^2$.

Embodiment 16. The abrasive article of Embodiment 1 or Embodiment 2, further comprising an average Bond Post Count (BPC) of not greater than 300 or not greater than 275 or not greater than 250 or not greater than 225 bond posts per 1.536 $mm^2$.

Embodiment 17. The abrasive article of Embodiment 1 or Embodiment 2, further comprising an average Bond Post Count (BPC) per vol % bond material of at least 7.5 or at least 7.6 or at least 7.7 or at least 7.8 or at least 7.9 or at least 8.0 or at least 8.1 or at least 8.2 or at least 8.3 or at least 8.4 or at least 8.5 bond posts per 1.536 $mm^2$ per bond vol %.

Embodiment 18. The abrasive article of Embodiment 1 or Embodiment 2, further comprising an average Bond Post Count (BPC) per vol % bond material of not greater than 10 or not greater than 9.9 or not greater than 9.8 or not greater than 9.7 or not greater than 9.6 or not greater than 9.5 bond posts per 1.536 $mm^2$ per bond vol %.

Embodiment 19. The abrasive article of Embodiment 1 or Embodiment 2, further comprising an average Bond Post Area (BPA) of at least 1300 $microns^2$ and not greater than 2400 $microns^2$, and further comprising an average Bond Post Count (BPC) of at least 40 bond posts per 1.536 $mm^2$ and not greater than 300 bond posts per 1.536 $mm^2$.

Embodiment 20. The abrasive article of Embodiment 1 or Embodiment 2, further comprising an average bond wetting radius of at least 30 microns or at least 31 microns or at least 32 microns or at least 33 microns or at least 34 microns or at least 35 microns or at least 36 microns or at least 37 microns or at least 38 microns or at least 39 microns or at least 40 microns.

Embodiment 21. The abrasive article of Embodiment 1 or Embodiment 2, further comprising an average bond wetting radius of not greater than 100 microns or not greater than 90 microns or not greater than 80 microns or not greater than 70 microns or not greater than 60 microns or not greater than 50 microns or not greater than 40 microns.

Embodiment 22. The abrasive article of Embodiment 1 or Embodiment 2, wherein the 10th percentile bond post area is at least 115 $micron^2$ and not greater than 125 $micron^2$.

Embodiment 23. The abrasive article of Embodiment 1 or Embodiment 2, wherein the 25th percentile bond post area is at least 300 $micron^2$ and not greater than 310 $micron^2$.

Embodiment 24. The abrasive article of Embodiment 1 or Embodiment 2, wherein the 50th percentile bond post area is at least 715 $micron^2$ and not greater than 735 $micron^2$.

Embodiment 25. The abrasive article of Embodiment 1 or Embodiment 2, wherein the 75th percentile bond post area is at least 1800 $micron^2$ and not greater than 1900 $micron^2$.

Embodiment 26. The abrasive article of Embodiment 1 or Embodiment 2, wherein the 90th percentile bond post area is at least 3500 $micron^2$ and not greater than 4000 $micron^2$.

Embodiment 27. The abrasive article of Embodiment 1 or Embodiment 2, wherein the body comprises a content of bond of at least 1 vol % for a total volume of the body or at least 2 vol % or at least 3 vol % or at least 4 vol % or at least 5 vol % or at least 6 vol % or at least 7 vol % or at least 8 vol % or at least 9 vol % or at least 10 vol % or at least 11 vol % or at least 12 vol % or at least 13 vol % or at least 14 vol % or at least 15 vol % or at least 16 vol % or at least 17 vol % or at least 18 vol % or at least 19 vol % or at least 20 vol % for a total volume of the body.

Embodiment 28. The abrasive article of Embodiment 1 or Embodiment 2, wherein the body comprises a bond content of not greater than 50 vol % for a total volume of the body or not greater than 48 vol % or not great than 46 vol % or not great than 44 vol % or not great than 42 vol % or not great than 40 vol % or not great than 38 vol % or not great than 36 vol % or not great than 34 vol % or not great than 32 vol % or not great than 30 vol % or not great than 28 vol % or not great than 26 vol % or not great than 24 vol % or not great than 22 vol % or not great than 20 vol % for a total volume of the body.

Embodiment 29. The abrasive article of Embodiment 1 or Embodiment 2, wherein the bond material comprises a content of $Al_2O_3$ of at least 18 wt % or at least 20 wt % or at least 22 wt %.

Embodiment 30. The abrasive article of Embodiment 1 or Embodiment 2, wherein the bond material comprises a content of $Al_2O_3$ of not greater than 36 wt % for a total content of the bond material or not greater than 33 wt % or not greater than 30 wt % or not greater than 27 wt %.

Embodiment 31. The abrasive article of Embodiment 1 or Embodiment 2, wherein the bond material comprises a content of $SiO_2$ of at least 38 wt % or at least 40 wt % or at least 42 wt % or at least 45 wt %.

Embodiment 32. The abrasive article of Embodiment 1 or Embodiment 2, wherein the bond material comprises a content of $B_2O_3$ of at least 10 wt % or not greater than 18 wt % or not greater than 15 wt % for a total content of the bond material.

Embodiment 33. The abrasive article of Embodiment 1 or Embodiment 2, wherein the bond material comprises a content of BaO of not greater than 0.6 wt % or not greater than 0.4 wt % or not greater than 0.2 wt % or not greater than 0.1 wt % or not greater than 0.05 wt % or not greater than 0.03 wt. % for a total content of the bond material.

Embodiment 34. The abrasive article of Embodiment 1 or Embodiment 2, wherein the bond material comprises a content of CaO of at least 0.3 wt % or not greater than 2 wt % or not greater than 1.5 wt % or not greater than 1 wt % or not greater than 0.5 wt % for a total content of the bond material.

Embodiment 35. The abrasive article of Embodiment 1 or Embodiment 2, wherein the bond material comprises a content of CoO of not greater than 0.7 wt % for a total content of the bond material.

Embodiment 36. The abrasive article of Embodiment 1 or Embodiment 2, wherein the bond material comprises a content of $Cr_2O_3$ of not greater than 0.01 wt % for a total content of the bond material.

Embodiment 37. The abrasive article of Embodiment 1 or Embodiment 2, wherein the bond material comprises a content of CuO of not greater than 0.01 wt % for a total content of the bond material.

Embodiment 38. The abrasive article of Embodiment 1 or Embodiment 2, wherein the bond material comprises a content of $Fe_2O_3$ of not greater than 0.8 wt % or not greater than 0.7 wt % for a total content of the bond material.

Embodiment 39. The abrasive article of Embodiment 1 or Embodiment 2, wherein the bond material comprises a content of $HfO_2$ of not greater than 0.02 wt % for a total content of the bond material.

Embodiment 40. The abrasive article of Embodiment 1 or Embodiment 2, wherein the bond material comprises a content of $K_2O$ of at least 0.5 wt % or not greater than 2 wt % or not greater than 1 wt % for a total content of the bond material.

Embodiment 41. The abrasive article of Embodiment 1 or Embodiment 2, wherein the bond material comprises a content of $La_2O_2$ of at least 1.3 wt % or not greater than 2.0 wt % or not greater than 1.5 wt % for a total content of the bond material.

Embodiment 42. The abrasive article of Embodiment 1 or Embodiment 2, wherein the bond material comprises a content of $Li_2O$ of at least 0.2 wt % or at least 0.5 wt % or at least 0.7 wt % or at least 0.9 wt %. or not greater 3 wt % or not greater than 2.5 wt % or not greater than 2.0 wt % or not greater than 1.5 wt % or not greater than 1.1 wt % for a total content of the bond material.

Embodiment 43. The abrasive article of Embodiment 1 or Embodiment 2, wherein the bond material comprises a content of MgO of at least 0.5 wt % or at least 0.7 wt % or not greater than 1.5 wt % or not greater than 1.0 wt % for a total content of the bond material.

Embodiment 44. The abrasive article of Embodiment 1 or Embodiment 2, wherein the bond material comprises a content of $MnO_2$ of not greater than 0.05 wt % for a total content of the bond material.

Embodiment 45. The abrasive article of Embodiment 1 or Embodiment 2, wherein the bond material comprises a content of $Na_2O$ of at least 4 wt % or not greater than 12 wt % or not greater than 9 wt % or not greater than 6 wt % for a total content of the bond material.

Embodiment 46. The abrasive article of Embodiment 1 or Embodiment 2, wherein the bond material comprises a content of NiO of not greater than 0.01 wt % for a total content of the bond material.

Embodiment 47. The abrasive article of Embodiment 1 or Embodiment 2, wherein the bond material comprises a content of SrO of not greater than 0.02 wt % for a total content of the bond material.

Embodiment 48. The abrasive article of Embodiment 1 or Embodiment 2, wherein the bond material comprises a content of $TiO_2$ of at least 0.2 wt % and not greater than 0.8 wt % for a total content of the bond material.

Embodiment 49. The abrasive article of Embodiment 1 or Embodiment 2, wherein the bond material comprises a content of $V_2O_5$ of not greater than 0.02 wt % for a total content of the bond material.

Embodiment 50. The abrasive article of Embodiment 1 or Embodiment 2, wherein the bond material comprises a content of $Y_2O_3$ of at least 0.4 wt % and not greater than 1.0 wt % for a total content of the bond material.

Embodiment 51. The abrasive article of Embodiment 1 or Embodiment 2, wherein the bond material comprises a content of ZnO of not greater than 0.2 wt % for a total content of the bond material.

Embodiment 52. The abrasive article of Embodiment 1 or Embodiment 2, wherein the bond material comprises a content of $ZrO_2$ of not greater than 0.01 wt % for a total content of the bond material.

Embodiment 53. The abrasive article of Embodiment 1 or Embodiment 2, wherein the body comprises a content of abrasive particles of at least 1 vol % for a total volume of the body or at least 5 vol % or at least 10 vol % or at least 15 vol % or at least 20 vol % or at least 25 vol % or at least 30 vol % or at least 32 vol % or at least 34 vol % or at least 36 vol % or at least 38 vol % or at least 40 vol % or at least 42 vol % or at least 44 vol % or at least 46 vol % or at least 48 vol % or at least 50 vol %.

Embodiment 54. The abrasive article of Embodiment 1 or Embodiment 2, wherein the body comprises a content of abrasive particles of not greater than 80 vol % for a total volume of the body or not greater than 78 vol % or not greater than 76 vol % or not greater than 74 vol % or not greater than 72 vol % or not greater than 70 vol % or not greater than 68 vol % or not greater than 66 vol % or not greater than 64 vol % or not greater than 62 vol % or not greater than 60 vol % or not greater than 58 vol % or not greater than 56 vol % or not greater than 54 vol % or not greater than 52 vol % or not greater than 50 vol % for a total volume of the body.

Embodiment 55. The abrasive article of Embodiment 1 or Embodiment 2, wherein the body comprises a ratio of abrasive particles vol %/bond vol % (APv/ABv) of at least 1 or at least 1.1 or at least 1.2 or at least 1.3 or at least 1.4 or at least 1.5 or at least 1.6 or at least 1.7 or at least 1.8 or at least 1.9 or at least 2.0 or at least 2.1 or at least 2.2 or at least 2.3 or at least 2.4 or at least 2.5 or at least 2.6.

Embodiment 56. The abrasive article of Embodiment 1 or Embodiment 2, wherein the body comprises a ratio of abrasive particles vol %/bond vol % (APv/ABv) of not greater than 10 or not greater than 9 or not greater than 8 or not greater than 7 or not greater than 6 or not greater than 5 or not greater than 4.5 or not greater than 4.0 or not greater than 3.9 or not greater than 3.8 or not greater than 3.7 or not greater than 3.6 or not greater than 3.5 or not greater than 3.4 or not greater than 3.3 or not greater than 3.2 or not greater than 3.1 or not greater than 3.0.

Embodiment 57. The abrasive article of Embodiment 1 or Embodiment 2, wherein the body comprises a content of porosity of at least 1 vol % or at least 2 vol % or at least 3 vol % or at least 4 vol % or at least 5 vol % or at least 6 vol % or at least 7 vol % or at least 8 vol % or at least 9 vol % or at least 10 vol % or at least 11 vol % or at least 12 vol % or at least 13 vol % or at least 14 vol % or at least 15 vol % or at least 16 vol % or at least 17 vol % or at least 18 vol % or at least 19 vol % or at least 20 vol % or at least 21 vol % or at least 22 vol % or at least 23 vol % or at least 24 vol % or at least 25 vol % or at least 26 vol % or at least 27 vol % or at least 28 vol % or at least 29 vol % or at least 30 vol %.

Embodiment 58. The abrasive article of Embodiment 1 or Embodiment 2, wherein the body comprises a content of porosity of not greater than 65 vol % for a total volume of the body or not greater than 60 vol % or not greater than 55 vol % or not greater than 50 vol % or not greater than 48 vol % or not great than 46 vol % or not great than 44 vol % or not great than 42 vol % or not great than 40 vol % or not great than 38 vol % or not great than 36 vol % or not great than 34 vol % or not great than 32 vol % or not great than 30 vol % for a total volume of the body.

Embodiment 59. The abrasive article of Embodiment 1 or Embodiment 2, wherein the abrasive particles define a multimodal particle size distribution.

Embodiment 60. The abrasive article of Embodiment 59, wherein the multimodal particle size distribution includes a fine mode and a coarse mode, wherein the coarse mode is at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns.

Embodiment 61. The abrasive article of Embodiment 59, wherein the multimodal particle size distribution includes a fine mode and a coarse mode, wherein the coarse mode is not greater than 1000 microns or not greater than 800 microns or not greater than 600 microns or not greater than 500 microns or not greater than 400 microns or not greater than 300 microns or not greater than 200 microns or not greater than 190 microns or not greater than 185 microns or not greater than 180 microns or not greater than 175 microns or not greater than 170 microns or not greater than 165 microns or not greater than 160 microns or not greater than 155 microns or not greater than 150 microns or not greater than 145 microns or not greater than 140 microns or not greater than 135 microns or not greater than 130 microns or not greater than 125 microns or not greater than 120 microns or not greater than 115 microns or not greater than 110 microns or not greater than 105 microns or not greater than 100 microns or not greater than 95 microns or not greater than 90 microns or not greater than 85 microns or not greater than 80 microns or not greater than 75 microns or not greater than 70 microns.

Embodiment 62. The abrasive article of Embodiment 59, wherein the multimodal particle size distribution includes a fine mode and a coarse mode, wherein the fine mode is at least 1 micron or at least 2 microns or at least 3 microns or at least 4 microns or at least 5 microns or at least 6 microns or at least 7 microns or at least 8 microns or at least 9 microns or at least 10 microns or at least 11 microns or at least 12 microns or at least 13 microns or at least 14 microns or at least 15 microns or at least 16 microns or at least 17 microns or at least 18 microns or at least 19 microns or at least 20 microns or at least 21 microns or at least 22 microns or at least 23 microns or at least 24 microns or at least 25 microns or at least 26 microns or at least 27 microns or at least 28 microns.

Embodiment 63. The abrasive article of Embodiment 59, wherein the multimodal particle size distribution includes a fine mode and a coarse mode, wherein the fine mode is not greater than 80 microns or not greater than 78 microns or not greater than 76 microns or not greater than 74 microns or not greater than 72 microns or not greater than 70 microns or not greater than 68 microns or not greater than 66 microns or not greater than 64 microns or not greater than 62 microns or not greater than 60 or not greater than 58 microns or not greater than 56 microns or not greater than 54 microns or not greater than 52 microns or not greater than 50 microns or not greater than 48 microns or not greater than 46 microns or not greater than 44 microns or not greater than 42 microns or not greater than 40 microns or not greater than 38 microns or not greater than 36 microns or not greater than 34 microns or not greater than 32 microns or not greater than 30 microns.

Embodiment 64. The abrasive article of Embodiment 59, wherein the multimodal particle size distribution includes a fine mode and a coarse mode, and further comprising a particle size difference between the fine mode and the coarse mode of at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns.

Embodiment 65. The abrasive article of Embodiment 59, wherein the multimodal particle size distribution includes a fine mode and a coarse mode, and further comprising a particle size difference between the fine mode and the coarse mode of not greater than 1000 microns or not greater than 800 microns or not greater than 600 microns or not greater than 500 microns or not greater than 400 microns or not greater than 300 microns or not greater than 200 microns or not greater than 190 microns or not greater than 185 microns or not greater than 180 microns or not greater than 175 microns or not greater than 170 microns or not greater than 165 microns or not greater than 160 microns or not greater than 155 microns or not greater than 150 microns or not greater than 145 microns or not greater than 140 microns or not greater than 135 microns or not greater than 130 microns or not greater than 125 microns or not greater than 120 microns or not greater than 115 microns or not greater than 110 microns or not greater than 105 microns or not greater than 100 microns or not greater than 95 microns or not greater than 90 microns or not greater than 85 microns or not greater than 80 microns or not greater than 75 microns or not greater than 70 microns.

Embodiment 66. The abrasive article of Embodiment 59, wherein the multimodal particle size distribution includes a fine mode and a coarse mode, and further comprising a vol % ratio [Vc/Vf] of at least 0.5, wherein Vc represents the vol % of the coarse abrasive particles having a particle size above the mean of the fine mode and the coarse mode and Vf represents the vol % of abrasive particles having a particle size below the mean of the fine mode and the coarse mode, or further wherein the vol % ratio [Vc/Vf] of at least 0.6 or at least 0.7 or at least 0.8 or at least 0.9 or at least 1 or at least 1.1 or at least 1.2 or at least 1.3 or at least 1.4 or at least 1.5 or at least 2 or at least 3 or at least 4 or at least 5 or at least 6 or at least 7 or at least 8.

Embodiment 67. The abrasive article of Embodiment 59, wherein the multimodal particle size distribution includes a fine mode and a coarse mode, and further comprising a vol % ratio [Vc/Vf] of not greater than 100 or not greater than 75 or not greater than 50 or not greater than 40 or not greater than 30 or not greater than 20 or not greater than 15 or not greater than 12 or not greater than 10 or not greater than 9 or not greater than 8 or not greater than 7 or not greater than 6 or not greater than 5.

Embodiment 68. The abrasive article of Embodiment 1, wherein the abrasive particles include a material comprising at least one of an oxide, carbide, nitride, boride, diamond, or any combination thereof.

Embodiment 69. The abrasive article of Embodiment 68, wherein the abrasive particles comprise at least one material from the group of alumina, silica, zirconia, or any combination thereof.

Embodiment 70. The abrasive article of Embodiment 69, wherein the abrasive particles comprise at least one of fused alumina, unseeded alumina, seeded sol-gel alumina, alumina with one or more magnetoplumbite-containing phases.

Embodiment 71. The abrasive article of Embodiment 69, wherein the abrasive particles comprise La or MgO, or a combination thereof.

Embodiment 72. The abrasive article of Embodiment 69, wherein the abrasive particles comprise a polycrystalline phase having crystalline domains, the crystalline domains having an average domain size of not greater than 8 microns or not greater than 7 microns or not greater than 6 microns or not greater than 5 microns or not greater than 4 microns or not greater than 3 microns or not greater than 2 microns or not greater than 1 micron or not greater than 0.5 microns or not greater than 0.3 microns according to the uncorrected intercept method.

Embodiment 73. The abrasive article of Embodiment 1 or Embodiment 2, wherein the abrasive particles include at least one of unshaped particles (e.g., crushed), shaped particles, agglomerated particles, unagglomerated particles.

Embodiment 74. The abrasive article of Embodiment 1 or Embodiment 2, wherein the body comprises an average density of at least 2.10 g/cm$^3$ or at least 2.15 g/cm$^3$ or at least 2.20 g/cm$^3$ or at least 2.25 g/cm$^3$ or at least 2.3 g/cm$^3$ or at least 2.35 g/cm$^3$.

Embodiment 75. The abrasive article of Embodiment 1 or Embodiment 2, wherein the body comprises an average density of not greater than 2.60 g/cm$^3$ or not greater than 2.55 g/cm$^3$.

Embodiment 76. The abrasive article of Embodiment 1 or Embodiment 2, wherein the body comprises a density variation of the body of not greater than 0.040 g/cm$^3$ or not greater than 0.035 g/cm$^3$ or not greater than 0.030 g/cm$^3$ or not greater than 0.025 g/cm$^3$ or not greater than 0.022 g/cm$^3$ or not greater than 0.020 g/cm$^3$ or not greater than 0.019 g/cm$^3$ or not greater than 0.018 g/cm$^3$ or not greater than 0.017 g/cm$^3$ or not greater than 0.016 g/cm$^3$ or not greater than 0.015 g/cm$^3$ or not greater than 0.014 g/cm$^3$ or not greater than 0.013 g/cm$^3$ or not greater than 0.012 g/cm$^3$ or not greater than 0.011 g/cm$^3$ or not greater than 0.010 g/cm$^3$.

Embodiment 77. The abrasive article of Embodiment 1 or Embodiment 2, wherein the body comprises a density variation of the body of at least 0.0001 g/cm$^3$ or at least 0.0005 g/cm$^3$ or at least 0.001 g/cm$^3$ or at least 0.005 g/cm$^3$ or at least 0.01 g/cm$^3$.

Embodiment 78. The abrasive article of Embodiment 1 or Embodiment 2, wherein the body is in the shape of a wheel.

Embodiment 79. The abrasive article of Embodiment 78, wherein the body has an outer diameter of at least 255 mm or at least 256 mm or at least 257 mm or at least 258 mm or at least 259 mm or at least 260 mm or at least 261 mm or at least 262 mm or at least 263 mm or at least 264 mm or at least 265 mm.

Embodiment 80. The abrasive article of Embodiment 78, wherein the body has an outer diameter of not greater than 500 mm or not greater than 475 mm or not greater than 450 mm or not greater than 425 mm or not greater than 400 mm or not greater than 380 mm or not greater than 360 mm or not greater than 340 mm or not greater than 320 mm or not greater than 300 mm or not greater than 280 mm.

Embodiment 81. The abrasive article of Embodiment 78, wherein the body has an inner diameter of at least 100 mm or at least 110 mm or at least 120 mm or at least 130 mm or at least 140 mm or at least 150 mm or at least 155 mm or at least 160 mm or at least 165 mm or at least 170 mm or at least 175 mm or at least 180 mm or at least 190 mm or at least 210 mm or at least 220 mm or at least 230 mm or at least 240 mm or at least 250 mm or at least 260 mm.

Embodiment 82. The abrasive article of Embodiment 78, wherein the body has an inner diameter of not greater than 350 mm or not greater than 340 mm or not greater than 330 mm or not greater than 320 mm or not greater than 310 mm or not greater than 300 mm or not greater than 290 mm or not greater than 280 mm or not greater than 270 mm or not greater than 260 mm or not greater than 250 mm or not greater than 240 mm or not greater than 230 mm or not greater than 220 mm or not greater than 210 mm or not greater than 200 mm or not greater than 190 mm or not greater than 180 mm.

Embodiment 83. The abrasive article of Embodiment 78, wherein the body has a thickness of at least 10 mm or at least 11 mm or at least 12 mm or at least 13 mm or at least 14 mm or at least 15 mm or at least 16 mm or at least 17 mm or at least 18 mm or at least 19 mm or at least 20 mm.

Embodiment 84. The abrasive article of Embodiment 78, wherein the body has a thickness of not greater than 100 mm or not greater than 95 mm or not greater than 90 mm or not greater than 85 mm or not greater than 80 mm or not greater than 75 mm or not greater than 70 mm or not greater than 65 mm or not greater than 60 mm or not greater than 55 mm or not greater than 50 mm or not greater than 45 mm or not greater than 40 mm or not greater than 35 mm or not greater than 30 mm.

Embodiment 85. A method of making an abrasive article of any of the preceding Embodiments comprising, providing a mixture of abrasive particles and a bond material precursor;

pressing the mixture into a green body;

firing the green body into a fully formed abrasive article.

Embodiment 86. The method of Embodiment 85, where pressing is performed with a pressing force of at least 300 Ton or at least 310 Ton or at least 320 Ton or at least 330 Ton or at least 340 Ton or at least 350 Ton or at least 360 Ton or at least 370 Ton or at least 380 Ton or at least 390 Ton or at least 400 Ton or at least 410 Ton or at least 420 Ton or at least 430 Ton or at least 440 Ton or at least 450 Ton or at least 460 Ton or at least 470 Ton or at least 480 Ton or at least 490 Ton or at least 500 Ton.

Embodiment 87. The method of Embodiment 85, where pressing is performed with a pressing force of not greater than 500 Ton or not greater than 490 Ton or not greater than 480 Ton or not greater than 470 Ton or not greater than 460 Ton or not greater than 450 Ton or not greater than 440 Ton or not greater than 430 Ton or not greater than 420 Ton or not greater than 410 Ton or not greater than 400 Ton or not greater than 390 Ton or not greater than 380 Ton or not greater than 370 Ton or not greater than 360 Ton or not greater than 350 Ton.

Embodiment 88. The method of Embodiment 85, further comprising drying the green body before firing the green body.

Embodiment 89. The method of Embodiment 88, wherein drying is performed with at least 30% humidity or at least 32% humidity or at least 34% humidity or at least 36% humidity or at least 38% humidity or at least 40% humidity or at least 42% humidity or at least 44% humidity or at least 46% humidity or at least 48% humidity or at least 50% humidity or at least 52% humidity or at least 54% humidity or at least 56% humidity or at least 58% humidity or at least 60% humidity.

Embodiment 90. The method of Embodiment 88, wherein drying is performed with no greater than 60% humidity or no greater than 58% humidity or no greater than 56% humidity or no greater than 54% humidity or no greater than 52% humidity or no greater than 50% humidity or no greater than 48% humidity or no greater than 46% humidity or no greater than 44% humidity or no greater than 42% humidity or no greater than 40% humidity or no greater than 38% humidity or no greater than 36% humidity or no greater than 34% humidity or no greater than 32% humidity or no greater than 30% humidity.

Embodiment 91. The method of Embodiment 88, wherein drying is performed at a temperature of at least 45° C. or at least 46° C. or at least 47° C. or at least 48° C. or at least 49° C. or at least 50° C. or at least 51° C. or at least 52° C. or at least 53° C. or at least 54° C. or at least 55° C. or at least 56° C. or at least 57° C. or at least 58° C. or at least 59° C. or at least 60° C.

Embodiment 92. The method of Embodiment 88, wherein drying is performed at a temperature of no greater than 80° C. no greater than 79° C. or no greater than 78° C. or no greater than 77° C. or no greater than 76° C. or no greater than 75° C. or no greater than 74° C. or no greater than 73° C. or no greater than 72° C. or no greater than 71° C. or no greater than 70° C. or no greater than 69° C. or no greater than 68° C. or no greater than 67° C. or no greater than 66° C. or no greater than 65° C. or no greater than 64° C. or no greater than 63° C. or no greater than 62° C. or no greater than 61° C. or no greater than 60° C. or no greater than 59° C. or no greater than 58° C. or no greater than 57° C. or no greater than 56° C. or no greater than 55° C. or no greater than 54° C. or no greater than 53° C. or no greater than 52° C. or no greater than 51° C. or no greater than 50° C.

Embodiment 93. The method of Embodiment 85, wherein firing is performed at a temperature of at least 900° C. or at least 905° C. or at least 910° C. or at least 915° C. or at least 920° C. or at least 925° C. or at least 930° C. or at least 935° C. or at least 940° C. or at least 945° C. or at least 950° C. or at least 955° C. or at least 960° C. or at least 965° C. or at least 970° C. or at least 975° C. or at least 980° C. or at least 995° C. or at least 1000° C.

Embodiment 94. The method of Embodiment 85, wherein firing is performed at a temperature of no greater than 1300° C. or no greater than 1290° C. or no greater than 1280° C. or no greater than 1270° C. or no greater than 1260° C. or no greater than 1250° C. or no greater than 1240° C. or no greater than 1230° C. or no greater than 1220° C. or no greater than 1210° C. or no greater than 1200° C. or no greater than 1190° C. or no greater than 1180° C. or no greater than 1170° C. or no greater than 1160° C. or no greater than 1150° C. or no greater than 1140° C. or no greater than 1130° C. or no greater than 1120° C. or no greater than 1110° C. or no greater than 1100° C. or no greater than 1090° C. or no greater than 1080° C. or no greater than 1070° C. or no greater than 1060° C. or no greater than 1050° C. or no greater than 1040° C. or no greater than 1030° C. or no greater than 1020° C. or no greater than 1010° C. no greater than 1000° C. or no greater than 995° C. or no greater than 990° C. or no greater than 985° C. or no greater than 980° C. or no greater than 75° C. or no greater than 970° C. or no greater than 965° C. or no greater than 960° C. or no greater than 955° C. or no greater than 950° C. or no greater than 945° C. or no greater than 940° C. or no greater than 935° C. or no greater than 930° C. or no greater than 925° C. or no greater than 920° C. or no greater than 915° C. or no greater than 910° C. or no greater than 905° C. or no greater than 900° C. or no greater than 890° C. or no greater than 880° C. or no greater than 870° C. or no greater than 860° C. or no greater than 850° C. or no greater than 840° C. or no greater than 830° C. or no greater than 820° C. or no greater than 810° C. or no greater than 800° C.

Embodiment 95. A method of using an abrasive article of any of the preceding Embodiments to abrade a workpiece, the method comprising, cutting, beveling, sharpening, gear power honing, worm gear grinding, CMR, stock removal, grinding, weld blending, or precision finishing.

Embodiment 96. The abrasive article of Embodiment 1 or Embodiment 2, wherein the body comprises a bond content of at least 1 wt % for a total weight of the body or at least 2 wt % or at least 3 wt % or at least 4 wt % or at least 5 wt % or at least 6 wt % or at least 7 wt % or at least 8 wt % or at least 9 wt % or at least 10 wt % or at least 11 wt % or at least 12 wt % or at least 13 wt % or at least 14 wt % or at least 15 wt % or at least 16 wt % or at least 17 wt % or at least 18 wt % or at least 19 wt % or at least 20 wt % for a total weight of the body.

Embodiment 97. The abrasive article of Embodiment 1 or Embodiment 2, wherein the body comprises a bond content of not greater than 50 wt % for a total weight of the body or not greater than 48 wt % or not great than 46 wt % or not great than 44 wt % or not great than 42 wt % or not great than 40 wt % or not great than 38 wt % or not great than 36 wt % or not great than 34 wt % or not great than 32 wt % or not great than 30 wt % or not great than 28 wt % or not great than 26 wt % or not great than 24 wt % or not great than 22 wt % or not great than 20 wt % for a total weight of the body.

Embodiment 98. The abrasive article of Embodiment 1 or Embodiment 2, wherein the bond material comprises a content of $SiO_2$ of not greater than 55 wt % for a total content of the bond material.

Embodiment 99. The abrasive article of Embodiment 1 or Embodiment 2, wherein the body comprises a content of abrasive particles of at least 1 wt % for a total weight of the body or at least 5 wt % or at least 10 wt % or at least 15 wt % or at least 20 wt % or at least 25 wt % or at least 30 wt % or at least 32 wt % or at least 34 wt % or at least 36 wt % or at least 38 wt % or at least 40 wt % or at least 42 wt % or at least 44 wt % or at least 46 wt % or at least 48 wt % or at least 50 wt %.

Embodiment 100. The abrasive article of Embodiment 1 or Embodiment 2, wherein the body comprises a content of abrasive particles of not greater than 80 wt % for a total weight of the body or not greater than 78 wt % or not greater than 76 wt % or not greater than 74 wt % or not greater than 72 wt % or not greater than 70 wt % or not greater than 68 wt % or not greater than 66 wt % or not greater than 64 wt % or not greater than 62 wt % or not greater than 60 wt % or not greater than 58 wt % or not greater than 56 wt % or not greater than 54 wt % or not greater than 52 wt % or not greater than 50 wt % for a total weight of the body.

Embodiment 101. The abrasive article of Embodiment 69, wherein the abrasive particles comprise a polycrystalline phase having crystalline domains, the crystalline domains having an average domain size of at least 0.1 microns or at least 0.2 microns or at least 0.3 microns or at least 0.4 microns or at least 0.5 microns or at least 0.75 microns or at least 1 microns or at least 1.5 microns or at least 2 microns or at least 2.5 microns or at least 3 microns or at least 3.5 microns or at least 4 microns or at least 4.5 microns or at least 5 microns.

Embodiment 102. The method of Embodiment 85, where pressing is performed with a pressing pressure of at least 90 MPa or at least 95 MPa or at least 100 MPa or at least 105 MPa or at least 110 MPa.

Embodiment 103. The method of Embodiment 85, where pressing is performed with a pressing pressure of no greater than 195 MPa or no greater than 190 MPa or no greater than 185 MPa or no greater than 180 MPa.

EXAMPLES

Sample bonded abrasives were made according to the following process. Mixtures were prepared according to Table 1, and the procedure below. Commercial samples CMS1, CMS2, and CMS3 were purchased.

TABLE 1

| Sample Specifications | | | | |
|---|---|---|---|---|
| | S1 | S2 | CS1 | CS2 |
| Abrasive Particles | | | | |
| Abrasive Particles (wt %) | (79 ± 2) | (84 ± 2) | (84 ± 2) | (84 ± 2) |
| Coarse particle grit size (d50; microns) | 70-90 | 70-90 | 70-90 | 70-90 |

TABLE 1-continued

| | | | | |
|---|---|---|---|---|
| | Sample Specifications | | | |
| Coarse particle wt % | 70-72 | 66-68 | 66-68 | 66-68 |
| Fine particle grit size(d50; microns) | 27-31 | 27-31 | 27-31 | 27-31 |
| Fine particle wt % | 7-9 | 16-18 | 16-18 | 16-18 |
| Grain crystalline domain size (micron) | 2-4 | 0.1-0.3 | 0.1-0.3 | 0.1-0.3 |
| | Bond System | | | |
| Bond Material(wt %) | 19-23 | 14-18 | 14-18 | 14-18 |
| Bond Wetting | Low | Low | High | High |
| | Processing Parameters | | | |
| Pressing Pressure | 110-180 MPa | 110-180 MPa | 110-180 MPa | 110-180 MPa |
| Drying Temp. | 50-60° C. | 50-60° C. | 50-60° C. | 50-60° C. |
| Drying Humidity | 30-60% | 30-60% | 30-60% | 30-60% |
| Firing Temperature | 900-1000° C. | 900-1000° C. | 900-1000° C. | 900-1000° C. |
| Default Dimensions | OD 265-275 mm; ID 165-175 mm; Thickness 20-30 mm<br>OD 395-405 mm; ID 295-305 mm; Thickness 25-35 mm | | | |
| | CS3 | CS4 | CS5 | CS6 |
| | Abrasive Particles | | | |
| Abrasive Particles (wt %) | (84 ± 2) | (84 ± 2) | (84 ± 2) | (84 ± 2) |
| Coarse particle grit size (d50; microns) | 70-90 | 70-90 | 70-90 | 70-90 |
| Coarse particle wt % | 66-68 | 66-68 | 66-68 | 70-72 |
| Fine particle grit size(d50; microns) | 27-31 | 27-31 | 27-31 | 27-31 |
| Fine particle wt % | 16-18 | 16-18 | 16-18 | 7-9 |
| Grain crystalline domain size (micron) | 0.1-0.3 | 0.1-0.3 | 0.1-0.3 | 2-4 |
| | Bond System | | | |
| Bond Material(wt %) | 14-18 | 14-18 | 14-18 | 19-23 |
| Bond Wetting | High | Medium | High | Medium |
| | Processing Parameters | | | |
| Pressing Pressure | 110-180 MPa | 110-180 MPa | 110-180 MPa | 110-180 MPa |
| Drying Temp. | 50-60° C. | 50-60° C. | 50-60° C. | 50-60° C. |
| Drying Humidity | 30-60% | 30-60% | 30-60% | 30-60% |
| Firing Temperature | 900-1000° C. | 900-1000° C. | 900-1000° C. | 900-1000° C. |
| Default Dimensions | OD 265-275 mm; ID 165-175 mm; Thickness 20-30 mm<br>OD 395-405 mm; ID 295-305 mm; Thickness 25-35 mm | | | |

The mixtures were pressed into green bodies. The green bodies were dried under controlled humidity. The dried green bodies are then fired into fully formed abrasive bodies. The abrasive bodies are then finished and profiled into the appropriate dimensions. Where relevant, dimensions are noted below.

Fired Bond Composition

Commercial samples and fired abrasive samples underwent ICP testing to determine the composition of the bond materials. The results in wt % can be found below in Table 2.

TABLE 2

| Material | S1 and S2 | CS1 | CS2 | CS3 | CS4 | CS5 | CS6 | CMS1 | CMS2 | CMS3 |
|---|---|---|---|---|---|---|---|---|---|---|
| $Al_2O_3$ | 22-27 | 13-19 | 13-19 | 16-22 | 34-38 | 30-35 | 17-21 | 15-20 | 23-29 | 35-40 |
| $SiO_2$ | 45-55 | 50-60 | 50-60 | 55-65 | 32-42 | 32-42 | 45-55 | 50-60 | 45-55 | 27-37 |
| $B_2O_3$ | 10-15 | 10-15 | 12-18 | 1-5 | 9-14 | 11-17 | 12-18 | 12-18 | 10-15 | 8-12 |
| BaO | 0.01-0.03 | | | | | | 0.3-0.5 | 0.4-0.6 | 0.02-0.04 | 0.05-0.07 |
| CaO | 0.3-0.5 | 0.2-0.5 | 0.5-0.7 | 2-2.5 | 0.9-1.1 | 0.5-1 | 1.2-1.5 | 0.01-0.03 | 0.01-0.03 | 2.0-2.5 |
| CoO | 0.05-0.07 | | | | | | 0.005-0.02 | 0.01-0.03 | 0.01-0.03 | 0.01-0.03 |
| $Cr_2O_3$ | <0.01 | | | | | | <0.01 | <0.001 | <0.001 | <0.001 |
| CuO | <0.01 | | | | | | <0.01 | 0.002-0.006 | <0.001 | <0.001 |
| $Fe_2O_3$ | 0.5-0.7 | 0.4-0.6 | 0.5-0.7 | 0.3-0.5 | 0.3-0.5 | 0.15-0.35 | 0.1-0.3 | <0.001 | <0.001 | <0.001 |
| $HfO_2$ | <0.02 | | | | 0.01-0.03 | 0.005-0.02 | <0.02 | <0.001 | 0.005-0.01 | 0.005-0.01 |
| $K_2O$ | 0.5-1 | 0.5-1.5 | 0.5-1.5 | 2.7-3.2 | 2.5-3 | 2.3-2.7 | 1-2 | 1-1.5 | 0.5-1 | 0.2-0.7 |
| $La_2O_2$ | 1.3-1.5 | | | | | | 0.3-0.5 | 0.8-1.0 | 1.6-1.8 | 0.7-0.9 |
| $Li_2O$ | 0.9-1.1 | 3.3-3.5 | 3.0-3.2 | <0.005 | 1.35-1.55 | 3.0-3.2 | 0.2-0.4 | <0.001 | 0.7-0.9 | 2.2-2.4 |
| MgO | 0.7-1.0 | 0.1-0.3 | 0.2-0.4 | 3-5 | 0.2-0.4 | 0.4-0.6 | 0.9-1.2 | 0.7-1.0 | 1.5-1.8 | 1.4-1.7 |
| $MnO_2$ | 0.005-0.02 | | | | | | 0.003-0.007 | <0.001 | <0.001 | <0.001 |
| $Na_2O$ | 4-6 | 8-10 | 8-10 | 5-7 | 7-9 | 8-9 | 7-8 | 7-8 | 6-7 | 7-8 |
| NiO | <0.01 | | | | 0 | 0 | <0.01 | <0.001 | <0.001 | <0.001 |
| SrO | 0.01-0.02 | | | | | | 0.005-0.02 | 0.004-0.006 | 0.002-0.004 | 0.001-0.003 |
| $TiO_2$ | 0.4-0.6 | 0.2-0.4 | 0.1-0.3 | 0.1-0.3 | 0.1-0.3 | 0.01-0.1 | 0.3-0.5 | 0.07-0.07 | 0.2-0.4 | 0.1-0.3 |
| $V_2O_5$ | 0.005-0.02 | | | | | | 0.001-0.01 | <0.001 | <0.001 | <0.001 |
| $Y_2O_3$ | 0.65-0.85 | | | | | | 0.05-0.25 | 0.35-0.55 | 0.1-0.3 | 0.4-0.6 |
| ZnO | 0.02-0.04 | | | | 0.01-0.03 | 0.005-0.02 | 0.06-0.08 | <0.001 | 0.005-0.02 | 0.02-0.04 |
| $ZrO_2$ | <0.01 | | | | 0.02-0.04 | 0.005-0.02 | <0.01 | 0.03-0.05 | 0.02-0.04 | |
| $CeO_2$ | | | | | | | | | | 2.7-3.2 |
| $ZrSiO_4$ | | | | | | | | | | 2.4-2.9 |

MOR, MOE, Density and Porosity

Sample bars were prepared according to the process above and finished into bars with dimensions 101 mm*25 mm*13 mm. Samples had their MOR evaluated according to Testing Standard ASTM D6272. The test was performed on a 3-point fixture with a support span of 50.8 and a test speed of 1.27 mm/min. Comparative samples with Dimensions 90 mm*24 mm*16 mm were normalized according to the cross sectional area of the samples.

Samples also had their MOE evaluated according to ASTM E1876-01. Porosity (vol %) of the articles was also measured. MOE, MOR and Porosity Data can be found below in Table 3.

TABLE 3

| Sample | Grain Vol % | Bond Vol % | Porosity Vol % | Density (g/cm) | MOR/MOE | MOE (GPa) | MOR (MPa) |
|---|---|---|---|---|---|---|---|
| S2 | 50-55% | 15-17% | 31-33% | 2.43 | 1.16 | 66.9 | 77.7 |
| CS1 | 50-55% | 15-17% | 31-33% | 2.43 | 0.95 | 58.3 | 55.2 |
| CS2 | 50-55% | 15-17% | 31-33% | 2.43 | 0.97 | 77.8 | 75.9 |
| CS3 | 50-55% | 15-17% | 31-33% | 2.43 | 1.00 | 70.0 | 70.2 |
| CS4 | 50-55% | 15-17% | 31-33% | 2.43 | 1.04 | 73.4 | 75.9 |
| CS5 | 50-55% | 31-33% | 31-33% | 2.43 | 1.05 | 75.7 | 79.5 |
| S1 | 45-50% | 20-22% | 30-32% | 2.38 | 1.07 | 66.5 | 70.9 |
| CMS1 | | | | | 0.90 | 69.9 | 62.9 |
| CMS2 | | | | | 0.91 | 68.3 | 62.2 |

Figure 9:
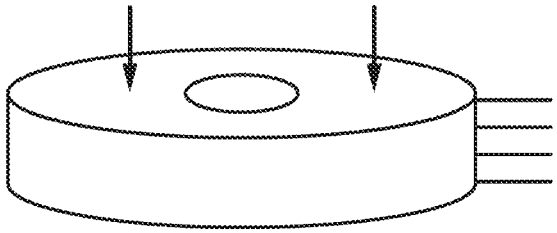
FIG. 9 includes an illustration of an abrasive article.

Sample density variation was measured by isolating 8 samples with dimensions 20 mm*15 mm*5 mm from each wheel. Samples were obtained from 4 layers at 2 different positions on each wheel as shown in FIG. 9.

Figure 10:
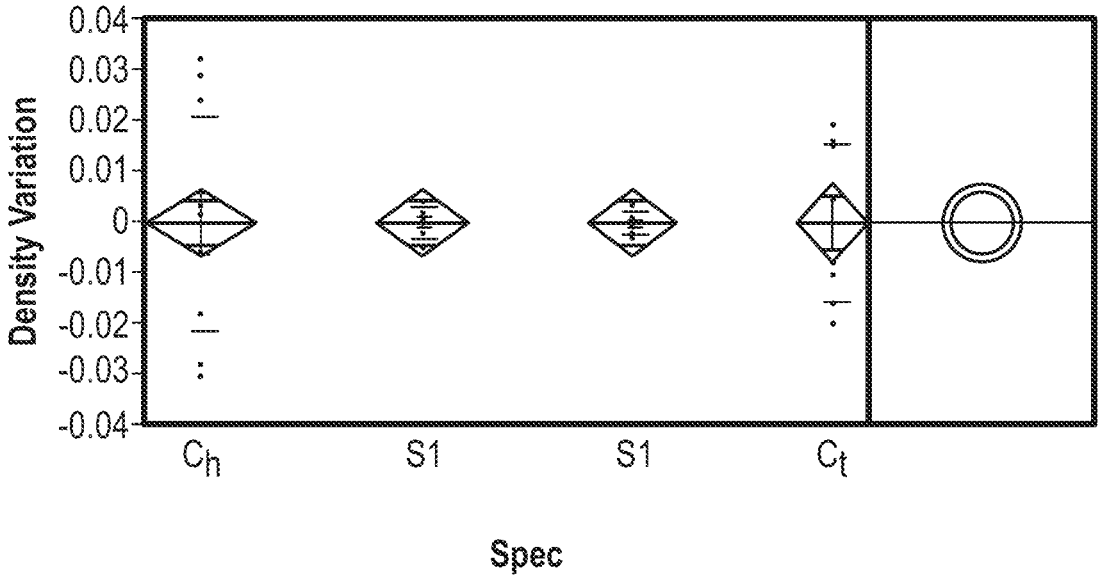
FIG. 10 includes a plot of density variation of various embodiments and commercial samples.

Samples were sealed by wax and then had their Archimedes density measured. The results of density variation measurements can be found in FIG. 10.

Bond Microstructure

Figure 5:
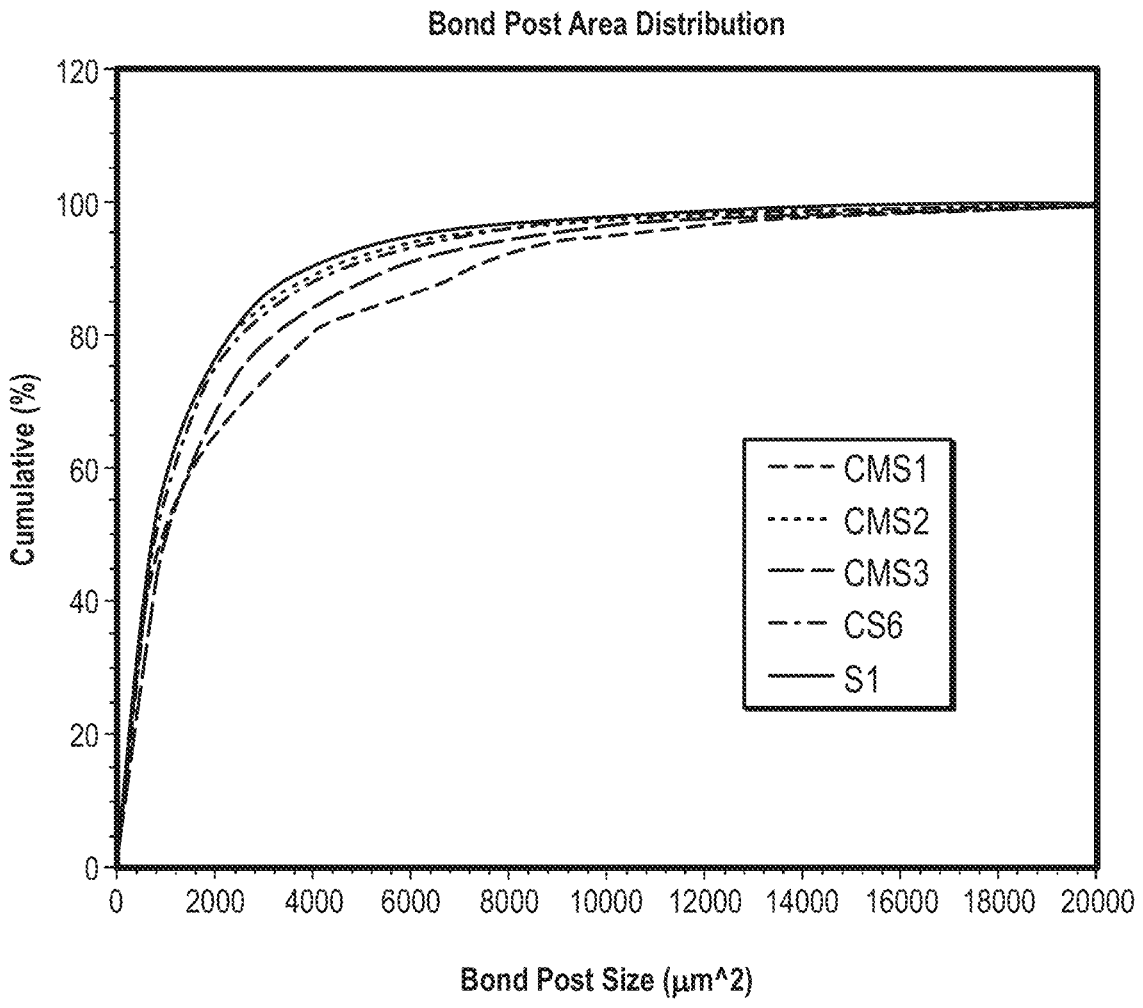
FIG. 5 includes a cumulative bond post size distribution for various embodiments, comparative samples, and commercial samples.

Different aspects of the bond microstructure were measured according to the following procedures. 10 SEM-EDS images of each sample were taken. ImageJ software was used to identify and highlight the bond structure of each sample. Example images of the bond structure can be seen in FIGS. 4A-C. ImageJ software was used to calculate the number of bond posts, as well as the area of the bond posts. The wetting ability of the bond was estimated by measuring the curvature of the radius of the bond posts at the bond interface. Bond post characterization data can be found in the tables below. FIG. 5 includes a cumulative bond post size distribution.

TABLE 4

| Samples | Average Bond post area (micron$^2$) | Average bond post area (micron$^2$) per bond vol % | Average bond post volume (micron$^3$) per bond vol % | Bond Post Count Per 1.536 mm$^2$ | Bond Post Count per 1.536 mm$^2$ per bond vol % |
|---|---|---|---|---|---|
| S1 | 1600-1730 | 130-140 | 3500-4000 | 185-195 | 8.5-9.5 |
| Cs6 | 1730-1860 | 145-150 | 4000-4500 | 185-195 | 8-9 |
| CMS1 | 2625-2750 | 215-220 | 7500-8000 | 120-130 | 5.5-6.5 |
| CMS2 | 1790-1920 | 148-153 | 4250-4750 | 180-190 | 8.5-9.5 |
| CMS3 | 2180-2430 | 185-190 | 6000-6500 | 140-150 | 6.5-7.5 |

TABLE 5

| Samples | S1 | Cs6 | CMS1 | CMS2 | CMS3 |
|---|---|---|---|---|---|
| Average Bond post area (micron$^2$) | 1600-1730 | 1730-1860 | 2625-2750 | 1790-1920 | 2180-2430 |
| Average bond post area (micron$^2$)per bond vol % | 130-140 | 145-150 | 215-220 | 148-153 | 185-190 |
| Average bond post volume(micron$^3$) per bond vol % | 3500-4000 | 4000-4500 | 7500-8000 | 4250-4750 | 6000-6500 |
| Bond Post Count Per 1.536 mm$^2$ | 185-195 | 185-195 | 120-130 | 180-190 | 140-150 |
| Bond Post Count per 1.536 mm$^2$ per bond vol % | 8.5-9.5 | 8-9 | 5.5-6.5 | 8.5-9.5 | 6.5-7.5 |
| 10$^{th}$ Percentile bond post area (micron$^2$) | 115-125 | 115-125 | 130-140 | 115-125 | 140-150 |
| 25$^{th}$ Percentile bond post area (micron$^2$) | 300-310 | 320-330 | 340-350 | 325-335 | 400-410 |
| 50$^{th}$ percentile bond post area (micron$^2$) | 715-735 | 775-795 | 930-950 | 850-870 | 1060-1080 |
| 75$^{th}$ percentile bond post area (micron$^2$) | 1800-1900 | 1900-2000 | 3100-3300 | 2000-2100 | 2600-2700 |
| 90$^{th}$ percentile bond post area (micron$^2$) | 3500-4000 | 4250-4750 | 7000-7500 | 4250-4750 | 5500-6000 |

The percentiles can be understood as follows: the X percentile bond post area is the area such that X % of the bond posts identified within the sample have the area not greater than the identified area.

Figure 11A:
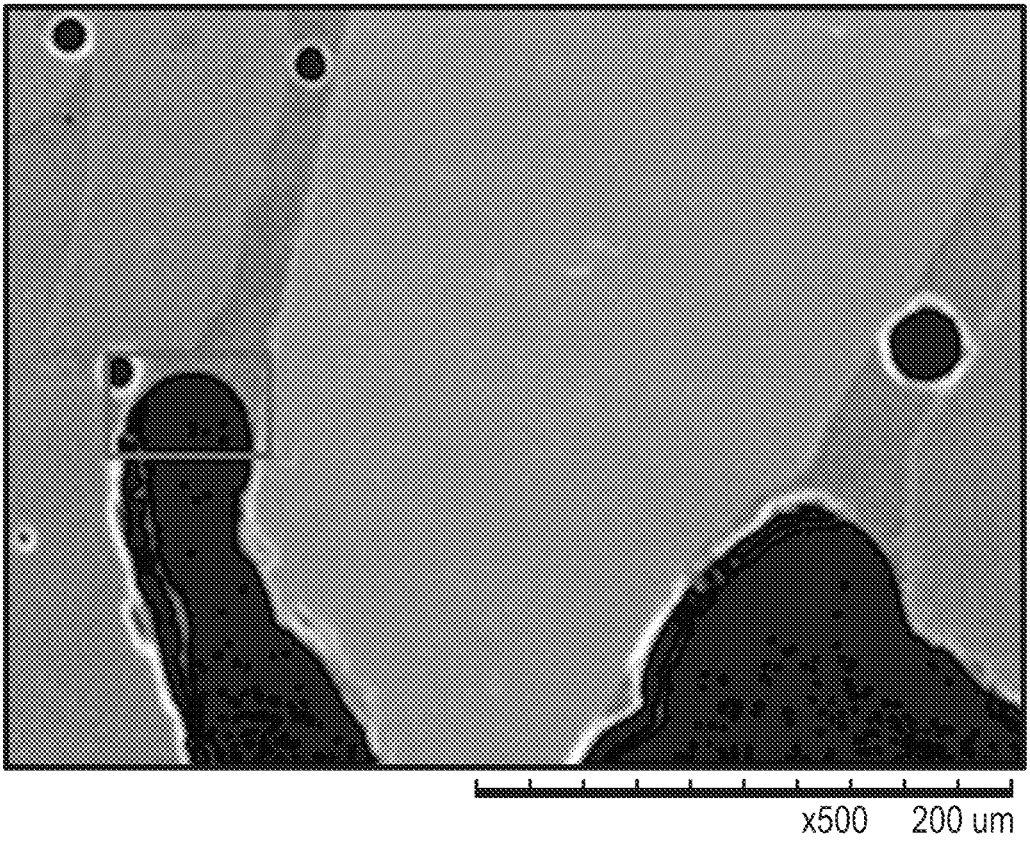
FIGS. 11A and B include exemplary images of bond posts for measuring bond post radii of curvature.
Figure 11B:
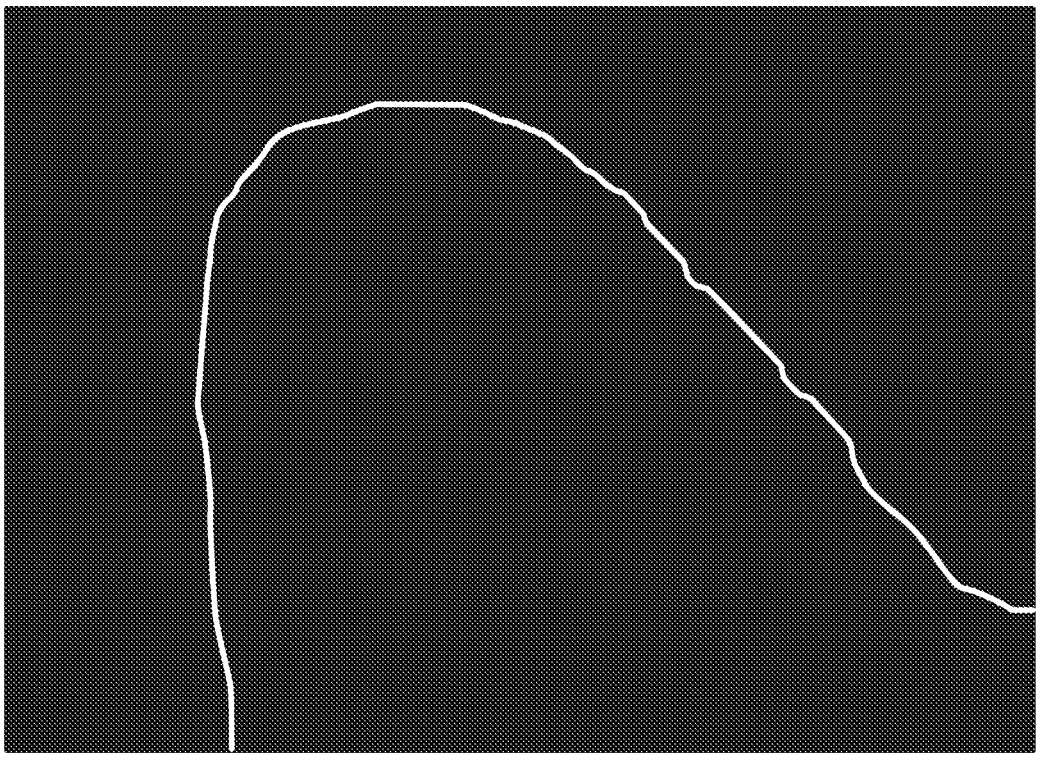

The wetting ability of each bond system was measured by calculating the bond post radius according to the following procedure. Images, such as the one in FIG. 11A, were taken. Bond areas are identified manually and then bond area profiles are identified using the binarization and smoothing functions in ImageJ as shown in FIG. 11B. Next, the profiles radius of curvature is calculated by fitting the profile to the equation below:

$$\kappa = \frac{x''y' - x'y''}{\left((x')^2 + (y')^2\right)^{3/2}}$$

The curve radian of the bond area should be 180°±10%. x, y are pixel coordinates of the image. x', y' is the First Derivative and x", y" is the Second Derivative.

Bond posts with the aforementioned are for each sample were identified and the radius of the curvature of the bond posts between the abrasive particles was measured. Low wetting bonds will have higher radii.

TABLE 6

| Sample | S1 | CS5 | CM2 |
|---|---|---|---|
| Wetting Radius (micron) | 40-50 | 20-30 | 15-25 |

The specification and illustrations of the embodiments described herein are intended to provide a general understanding of the structure of the various embodiments. The specification and illustrations are not intended to serve as an exhaustive and comprehensive description of all the elements and features of apparatus and systems that use the structures or methods described herein. Separate embodiments may also be provided in combination in a single embodiment, and conversely, various features that are, for brevity, described in the context of a single embodiment, may also be provided separately or in any sub-combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present), and B is false (or not present), A is false (or not present), and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents and shall not be restricted or limited by the foregoing detailed description.

What is claimed is:

1. An abrasive article comprising:

a body comprising:

a bond material comprising an inorganic material;

abrasive particles contained in a bond material;

a MOR/EMOD ratio of at least 0.92; a bond vol % of less than 18%, a porosity of at least 1 vol % and not greater than 65 vol %, and wherein the body further comprises at least one of:

a) an average Bond Post Area (BPA) of not greater than 2400 microns$^2$;

b) an average Bond Post Count (BPC) of at least 140 per 1.536 mm$^2$;

c) an average bond wetting radius of at least 30 microns; and d) a combination of a) and b).

2. The abrasive article of claim 1, further comprising an average Bond Post Area (BPA) of not greater 2400 micron$^2$.

3. The abrasive article of claim 1, further comprising an average Bond Post Count (BPC) per 1.536 mm$^2$ of at least 140 bond posts per 1.536 mm$^2$.

4. The abrasive article of claim 1, further comprising an average Bond Post Area (BPA) of at least 400 micron$^2$ and not greater than 925 micron$^2$, and further comprising an average Bond Post Count (BPC) per 1.536 mm$^2$ of at least 40 and not greater than 300 bond posts per 1.536 mm$^2$.

5. The abrasive article of claim 1, further comprising an average bond wetting radius of at least 30 microns.

6. The abrasive article of claim 1, wherein the 25$^{th}$ percentile bond post area is at least 770 micron$^2$ and not greater than 795 micron$^2$.

7. The abrasive article of claim 1, wherein the 50$^{th}$ percentile bond post area is at least 1830 micron$^2$ and not greater than 1880 micron$^2$.

8. The abrasive article of claim 1, wherein the 75$^{th}$ percentile bond post area is at least 4600 micron$^2$ and not greater than 4850 micron$^2$.

9. The abrasive article of claim 1, comprising an average Bond Post Volume BPV) per vol % bond material of not greater than 6000 micron$^3$.

10. The abrasive article of claim 1, wherein the abrasive particles define a multimodal particle size distribution.

* * * * *